US010734714B2

(12) United States Patent
Ruaro et al.

(10) Patent No.: US 10,734,714 B2
(45) Date of Patent: Aug. 4, 2020

(54) ELECTRONIC DEVICE WIDE BAND ANTENNAS

(71) Applicant: Apple Inc., Cupertino, CA (US)

(72) Inventors: Andrea Ruaro, Campbell, CA (US); Mario Martinis, Cupertino, CA (US); Jiaxiao Niu, Shanghai (CN); Eduardo Jorge Da Costa Bras Lima, Sunnyvale, CA (US); Dimitrios Papantonis, Cupertino, CA (US); Jayesh Nath, Milpitas, CA (US); Zheyu Wang, Sunnyvale, CA (US); Carlo Di Nallo, Belmont, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 143 days.

(21) Appl. No.: 15/991,498

(22) Filed: May 29, 2018

(65) Prior Publication Data

US 2019/0372205 A1 Dec. 5, 2019

(51) Int. Cl.
*H01Q 1/27* (2006.01)
*G04G 21/04* (2013.01)
(Continued)

(52) U.S. Cl.
CPC ..... *H01Q 1/273* (2013.01); *G04G 21/04* (2013.01); *H01Q 1/243* (2013.01); *H01Q 5/357* (2015.01); *H01Q 21/30* (2013.01); *H01Q 1/38* (2013.01)

(58) Field of Classification Search
CPC ..... H01Q 1/273; H01Q 1/243; H01Q 21/30; H01Q 5/357; H01Q 1/38; G04G 21/04
See application file for complete search history.

(56) References Cited

U.S. PATENT DOCUMENTS 9,024,823 B2 5/2015 Bevelacqua
9,070,969 B2 7/2015 Mow et al.
(Continued)

FOREIGN PATENT DOCUMENTS

KR 10-2017-0020139 2/2017
KR 10-2018-0018371 2/2018

OTHER PUBLICATIONS

Andrea Ruaro et al., "Ground plane boosters as a compact antenna technology for wireless handheld devices". IEEE Transactions on Antennas and Propagation 59.5 (2011): 1668-1677.
(Continued)

*Primary Examiner* — Dameon E Levi
*Assistant Examiner* — David E Lotter
(74) *Attorney, Agent, or Firm* — Treyz Law Group, P.C.; Michael H. Lyons

(57) ABSTRACT

An electronic device such as a wristwatch may have a housing with metal sidewalls and a display having conductive display structures. The display structures may be separated from the sidewalls by a slot for an antenna that runs around the display module. A conductive interconnect may be coupled between the sidewalls and the display structures. A feed and tuning element may be coupled between the display structures and the sidewalls. A first length of the slot from the interconnect to the tuning element may radiate in a satellite band and a cellular band. A second length of the slot from the interconnect to the feed may radiate in a 2.4 GHz band. Harmonics of the second length may radiate in bands at and above 5.0 GHz. If desired, the tuning element may be omitted, and the antenna may be coupled to separate low band and high band matching circuits.

20 Claims, 14 Drawing Sheets

(51) Int. Cl.

| | |
|---|---|
| ***H01Q 5/357*** | (2015.01) |
| ***H01Q 21/30*** | (2006.01) |
| ***H01Q 1/24*** | (2006.01) |
| *H01Q 1/38* | (2006.01) |

(56) References Cited

U.S. PATENT DOCUMENTS

| | | | | |
|---|---|---|---|---|
| 9,608,310 | B2 | 3/2017 | Huang | |
| 2009/0256757 | A1* | 10/2009 | Chiang | H01Q 1/2266 343/702 |
| 2011/0133995 | A1* | 6/2011 | Pascolini | H01Q 7/00 343/702 |
| 2011/0136447 | A1* | 6/2011 | Pascolini | H01Q 1/243 455/90.2 |
| 2011/0241949 | A1* | 10/2011 | Nickel | H01Q 1/243 343/702 |
| 2012/0050114 | A1* | 3/2012 | Li | H01Q 1/2266 343/702 |
| 2012/0299785 | A1* | 11/2012 | Bevelacqua | H01Q 9/42 343/702 |
| 2013/0257659 | A1* | 10/2013 | Darnell | H01Q 1/243 343/702 |
| 2013/0293424 | A1* | 11/2013 | Zhu | H01Q 1/243 343/702 |
| 2014/0300832 | A1* | 10/2014 | de Jong | G06F 3/041 349/12 |
| 2016/0064812 | A1* | 3/2016 | Han | H01Q 1/50 343/702 |
| 2016/0218416 | A1 | 7/2016 | Van Wonterghem | |
| 2016/0226132 | A1 | 8/2016 | Kim et al. | |

OTHER PUBLICATIONS

Andrea Ruaro et al., U.S. Appl. No. 15/698,481, filed Sep. 7, 2017.
Carlo Di Nallo et al., U.S. Appl. No. 15/718,288, filed Sep. 28, 2017.
Andrea Ruaro et al., U.S. Appl. No. 15/903,733, filed Feb. 23, 2018.
Rex T. Ehman et al., U.S. Appl. No. 15/234,907, filed Aug. 11, 2016.
Rex T. Ehman et al. , U.S. Appl. No. 15/234,918, filed Aug. 11, 2016.

* cited by examiner

ELECTRONIC DEVICE WIDE BAND ANTENNAS

BACKGROUND

This relates to electronic devices, and more particularly, to antennas for electronic devices with wireless communications circuitry.

Electronic devices are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device such as a wristwatch may have a housing with metal portions such as metal sidewalls. A display may be mounted on a front face of the device. The display may include a display module with conductive display structures and a display cover layer that overlaps the display module. The conductive display structures may include portions of a touch sensor layer, portions of a display layer that displays images, portions of a near field communications antenna layer, a metal frame for the display module, a metal back plate for the display module, or other conductive structures.

The electronic device may include wireless communications circuitry. The wireless communications circuitry may include radio-frequency transceiver circuitry and an antenna such as a slot antenna. The conductive display structures may be separated from the metal sidewalls by a slot that runs laterally around the display module. The slot antenna may be fed using an antenna feed having a first feed terminal coupled to the conductive display structures and a second feed terminal coupled to the metal sidewalls. A conductive interconnect structure may be coupled to the metal sidewalls (e.g., using a conductive fastener) and may extend across the slot to the display module. The metal sidewalls, the conductive display structures, and the conductive interconnect structure may define the edges of a slot element for the slot antenna. A tuning element may be coupled between the conductive display structures and the conductive housing walls across the slot element.

A first length of the slot element extending from the conductive interconnect structure to the tuning element may be configured to radiate in a first frequency band such as a frequency band that includes a satellite navigation frequency band and a cellular telephone frequency band. A second length of the slot element extending from the conductive interconnect structure to the antenna feed may be configured to radiate in a second frequency band such as a 2.4 GHz wireless local area network frequency band. Harmonics of the second length of the slot element may be configured to radiate in a third frequency band such as a frequency band that includes a 5.0 wireless local area network frequency band and an ultra-wide band (UWB) frequency band between 5.0 GHz and 8.3 GHz. If desired, the tuning element may be omitted, and the antenna may be coupled to separate low band and high band impedance matching circuits. In this way, the antenna may operate with satisfactory antenna efficiency across a wide range of frequency bands including UWB frequency bands despite form factor limitations for the electronic device.

DETAILED DESCRIPTION

Figure 1:
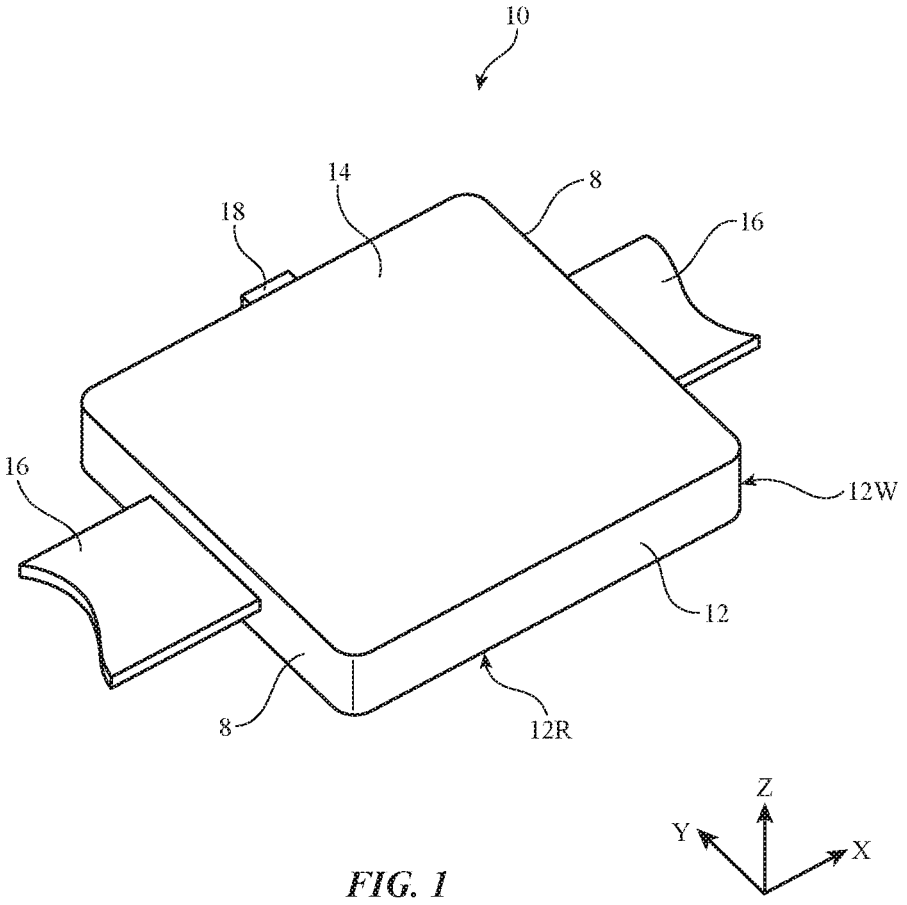
FIG. 1 is a front perspective view of an illustrative electronic device in accordance with an embodiment.

An electronic device such as electronic device 10 of FIG. 1 may be provided with wireless circuitry. The wireless circuitry may be used to support wireless communications in multiple wireless communications (frequency) bands. The wireless circuitry may include antennas. Antennas may be formed from electrical components such as displays, touch sensors, near-field communications antennas, wireless power coils, peripheral antenna resonating elements, conductive traces, and device housing structures, as examples.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a wristwatch (e.g., a smart watch). Other configurations may be used for device 10 if desired. The example of FIG. 1 is merely illustrative.

In the example of FIG. 1, device 10 includes a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Housing 12 may have metal sidewalls such as sidewalls 12W or sidewalls formed from other materials. Examples of metal materials that may be used for forming sidewalls 12W include stainless steel, aluminum, silver, gold, metal alloys, or any other desired conductive material. Sidewalls 12W may sometimes be referred to herein as conductive sidewalls 12W or conductive housing sidewalls 12W.

Display 14 may be formed at (e.g., mounted on) the front side (face) of device 10. Housing 12 may have a rear housing wall on the rear side (face) of device 10 such as rear housing wall 12R that opposes the front face of device 10. Conductive sidewalls 12W may surround the periphery of device 10 (e.g., conductive sidewalls 12W may extend around peripheral edges of device 10). Rear housing wall 12R may be formed from conductive materials and/or dielectric materials. Examples of dielectric materials that may be used for forming rear housing wall 12R include plastic, glass, sapphire, ceramic, wood, polymer, combinations of these materials, or any other desired dielectrics.

Rear housing wall 12R and/or display 14 may extend across some or all of the length (e.g., parallel to the X-axis of FIG. 1) and width (e.g., parallel to the Y-axis) of device 10. Conductive sidewalls 12W may extend across some or all of the height of device 10 (e.g., parallel to Z-axis). Conductive sidewalls 12W and/or the rear housing wall 12R may form one or more exterior surfaces of device 10 (e.g., surfaces that are visible to a user of device 10) and/or may be implemented using internal structures that do not form exterior surfaces of device 10 (e.g., conductive or dielectric housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide housing walls 12R and/or 12W from view of the user).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer. The display cover layer may be formed from a transparent material such as glass, plastic, sapphire or other crystalline dielectric materials, ceramic, or other clear materials. The display cover layer may extend across substantially all of the length and width of device 10, for example.

Device 10 may include buttons such as button 18. There may be any suitable number of buttons in device 10 (e.g., a single button, more than one button, two or more buttons, five or more buttons, etc.). Buttons may be located in openings in housing 12 (e.g., openings in conductive sidewall 12W or rear housing wall 12R) or in an opening in display 14 (as examples). Buttons may be rotary buttons, sliding buttons, buttons that are actuated by pressing on a movable button member, etc. Button members for buttons such as button 18 may be formed from metal, glass, plastic, or other materials. Button 18 may sometimes be referred to as a crown in scenarios where device 10 is a wristwatch device.

Device 10 may, if desired, be coupled to a strap such as strap 16. Strap 16 may be used to hold device 10 against a user's wrist (as an example). Strap 16 may sometimes be referred to herein as wrist strap 16. In the example of FIG. 1, wrist strap 16 is connected to opposing sides 8 of device 10. Conductive sidewalls 12W on sides 8 of device 10 may include attachment structures for securing wrist strap 16 to housing 12 (e.g., lugs or other attachment mechanisms that configure housing 12 to receive wrist strap 16). Configurations that do not include straps may also be used for device 10.

Figure 2:
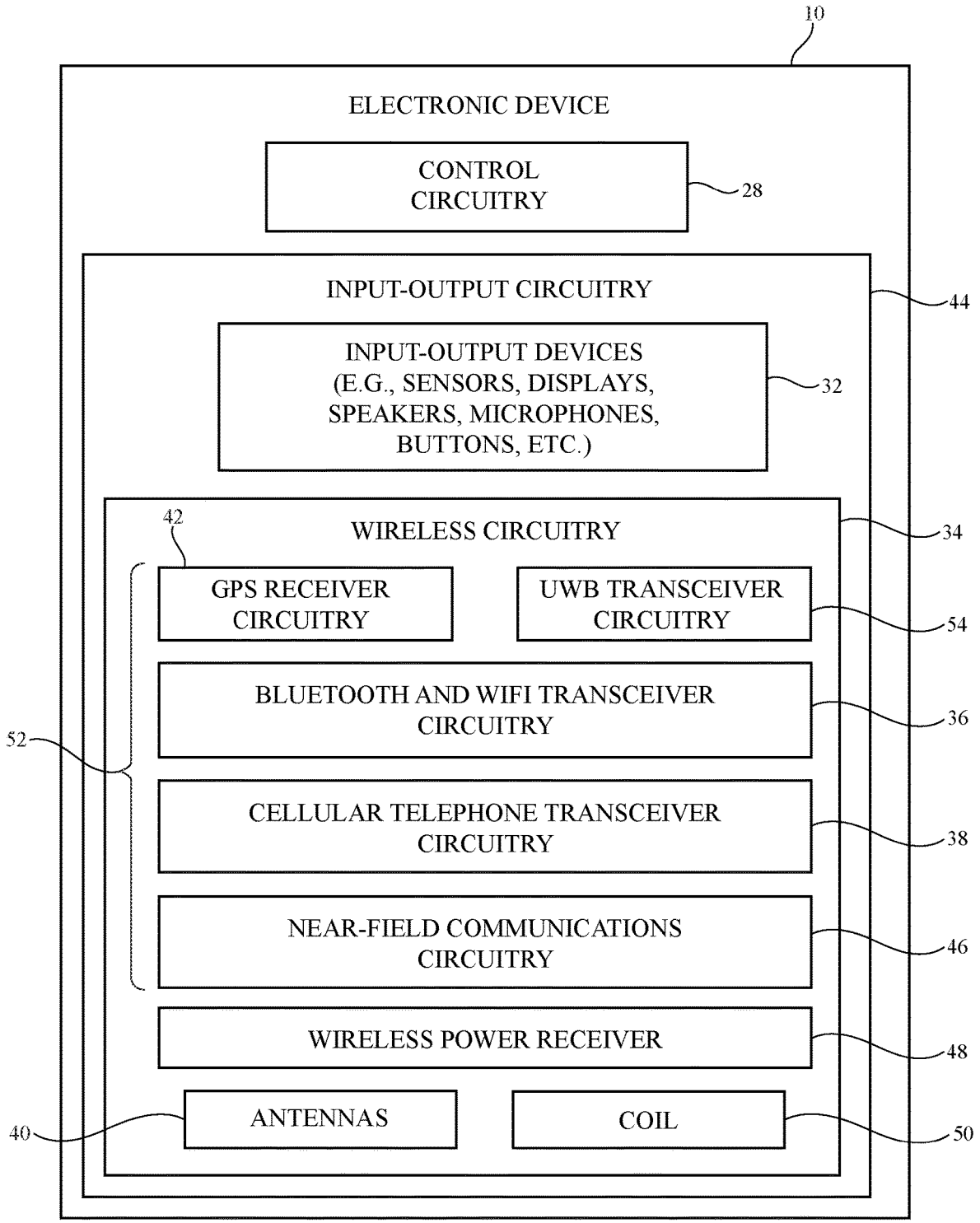
FIG. 2 is a schematic diagram of an illustrative electronic device in accordance with an embodiment.

A schematic diagram showing illustrative components that may be used in device 10 is shown in FIG. 2. As shown in FIG. 2, device 10 may include storage and processing circuitry such as control circuitry 28. Control circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 28 may be used to control the operation of device 10. This processing circuitry may be based on one or more microprocessors, microcontrollers, digital signal processors, application specific integrated circuits, etc.

Control circuitry 28 may be used to run software on device 10, such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network (WLAN) protocols (e.g., IEEE 802.11 protocols—sometimes referred to as WiFi®), protocols for other short-range wireless communications links such as the Bluetooth® protocol or other wireless personal area network (WPAN) protocols, cellular telephone protocols, MIMO protocols, antenna diversity protocols, satellite navigation system protocols, millimeter wave communications protocols, IEEE 802.15.4 ultra-wideband communications protocols or other ultra-wideband communications protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, scrolling wheels, touch pads, key pads, keyboards, microphones, cameras, buttons, speakers, status indicators, light sources, audio jacks and other audio port components, vibrators or other haptic feedback engines, digital data port devices, light sensors (e.g., infrared light sensors, visible light sensors, etc.), light-emitting diodes, motion sensors (accelerometers), capacitance sensors, proximity sensors, magnetic sensors, force sensors (e.g., force sensors coupled to a display to detect pressure applied to the display), etc.

Input-output circuitry 44 may include wireless circuitry 34 (sometimes referred to herein as wireless communications circuitry 34). Wireless circuitry 34 may include coil 50 and wireless power receiver 48 for receiving wirelessly transmitted power from a wireless power adapter. Wireless power receiver 48 may include, for example, rectifier circuitry and other circuitry for powering or charging a battery on device 10 using wireless power received by coil 50. Coil 50 may, as an example, receive wireless power through rear housing wall 12R (FIG. 1) when mounted to a wireless power adapter. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

Wireless circuitry 34 may include radio-frequency transceiver circuitry 52 for handling various radio-frequency communications bands. For example, wireless circuitry 34 may include transceiver circuitry 36, 38, 42, 46, and 54. Transceiver circuitry 36 may be wireless local area network transceiver circuitry. Transceiver circuitry 36 may handle 2.4 GHz and 5 GHz bands for WiFi® (IEEE 802.11) communications or other WLAN bands and may handle the 2.4 GHz Bluetooth® communications band or other WPAN bands. Transceiver circuitry 36 may sometimes be referred to herein as WLAN transceiver circuitry 36.

Wireless circuitry 34 may use cellular telephone transceiver circuitry 38 (sometimes referred to herein as cellular transceiver circuitry 38) for handling wireless communications in frequency ranges (communications bands) such as a low band (sometimes referred to herein as a cellular low band LB) from 600 to 960 MHz, a midband (sometimes referred to herein as a cellular midband MB) from 1400 MHz or 1700 MHz to 2170 or 2200 MHz, and a high band (sometimes referred to herein as a cellular high band HB) from 2200 or 2300 to 2700 MHz (e.g., a high band with a peak at 2400 MHz) or other communications bands between 600 MHz and 4000 MHz or other suitable frequencies (as examples). Cellular transceiver circuitry 38 may handle voice data and non-voice data.

Wireless circuitry 34 may include satellite navigation system circuitry such as Global Positioning System (GPS) receiver circuitry 42 for receiving GPS signals at 1575 MHz or for handling other satellite positioning data (e.g., GLONASS signals at 1609 MHz). Satellite navigation system signals for receiver 42 are received from a constellation of satellites orbiting the earth. Wireless circuitry 34 can include circuitry for other short-range and long-range wireless links if desired. For example, wireless circuitry 34 may include circuitry for receiving television and radio signals, paging system transceivers, near field communications (NFC) transceiver circuitry 46 (e.g., an NFC transceiver operating at 13.56 MHz or another suitable frequency), etc.

In NFC links, wireless signals are typically conveyed over a few inches at most. In satellite navigation system links, cellular telephone links, and other long-range links, wireless signals are typically used to convey data over thousands of feet or miles. In WLAN and WPAN links at 2.4 and 5 GHz and other short-range wireless links, wireless signals are typically used to convey data over tens or hundreds of feet.

Ultra-wideband (UWB) transceiver circuitry 54 may support communications using the IEEE 802.15.4 protocol and/or other wireless communications protocols (e.g., ultra-wideband communications protocols). Ultra-wideband wireless signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Transceiver circuitry 54 may operate (i.e., convey radio-frequency signals) in frequency bands such as an ultra-wideband frequency band between about 5 GHz and about 8.3 GHz (e.g., a 6.5 GHz frequency band, an 8 GHz frequency band, and/or at other suitable frequencies).

Wireless circuitry 34 may include antennas 40. Antennas 40 may be formed using any suitable antenna types. For example, antennas 40 may include antennas with resonating elements that are formed from slot antenna structures, loop antenna structures, patch antenna structures, stacked patch antenna structures, antenna structures having parasitic elements, inverted-F antenna structures, planar inverted-F antenna structures, helical antenna structures, monopole antennas, dipole antenna structures, Yagi (Yagi-Uda) antenna structures, surface integrated waveguide structures, hybrids of these designs, etc. If desired, one or more of antennas 40 may be cavity-backed antennas.

Different types of antennas may be used for different bands and combinations of bands. For example, one type of antenna may be used in forming a local wireless link antenna whereas another type of antenna is used in forming a remote wireless link antenna. If desired, space may be conserved within device 10 by using a single antenna to handle two or more different communications bands. For example, a single antenna 40 in device 10 may be used to handle communications in a WiFi® or Bluetooth® communication band at 2.4 GHz, a GPS communications band at 1575 MHz, a WiFi® communications band at 5.0 GHz, one or more cellular telephone communications bands such as a cellular midband between about 1700 MHz and 2200 MHz and a cellular high band between about 2200 and 2700 MHz, and UWB communications band between about 5 GHz and 8.3 GHz. If desired, a combination of antennas for covering multiple frequency bands and dedicated antennas for covering a single frequency band may be used.

It may be desirable to implement at least some of the antennas in device 10 using portions of electrical components that would otherwise not be used as antennas and that support additional device functions. As an example, it may be desirable to induce antenna currents in components such as display 14 (FIG. 1), so that display 14 and/or other electrical components (e.g., a touch sensor, near-field communications loop antenna, conductive display assembly or housing, conductive shielding structures, etc.) can serve as part of an antenna for Wi-Fi, Bluetooth, GPS, cellular frequencies, UWB, and/or other frequencies without the need to incorporate separate bulky antenna structures in device 10.

Figure 3:
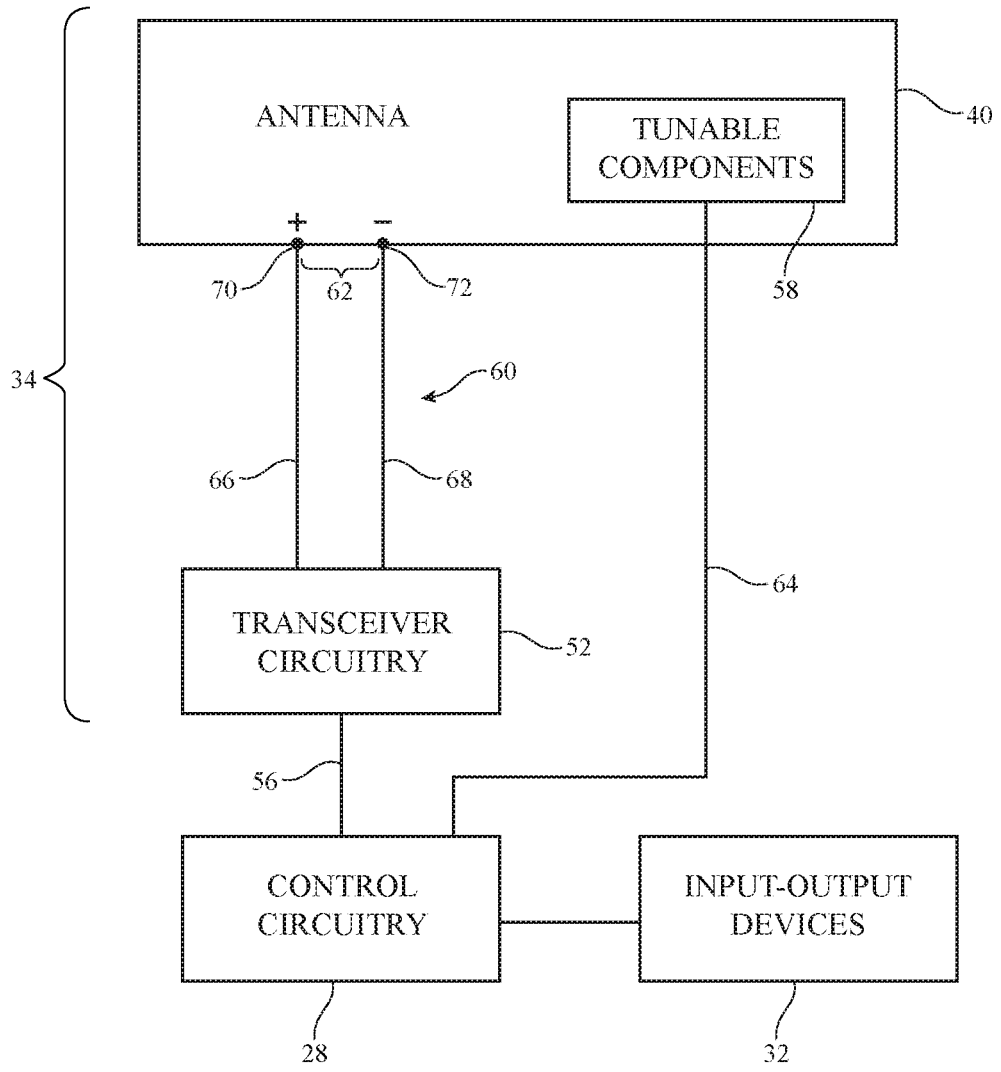
FIG. 3 is a diagram of illustrative wireless circuitry in an electronic device in accordance with an embodiment.

FIG. 3 is a diagram showing how transceiver circuitry 52 in wireless circuitry 34 may be coupled to antenna structures of a corresponding antenna 40 using signal paths such as signal path 60. Wireless circuitry 34 may be coupled to control circuitry 28 over data and control path 56. Control circuitry 28 may be coupled to input-output devices 32. Input-output devices 32 may supply output from device 10 and may receive input from sources that are external to device 10.

To provide antenna 40 with the ability to cover communications bands (frequencies) of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 58 to tune the antenna over communications bands of interest. Tunable components 58 may include tunable inductors, tunable capacitors, or other tunable components. Tunable components such as these may be based on switches and networks of fixed components, distributed metal structures that produce associated distributed capacitances and inductances, variable solid-state devices for producing variable capacitance and inductance values, tunable filters, or other suitable tunable structures.

During operation of device 10, control circuitry 28 may issue control signals on one or more paths such as path 64 that adjust inductance values, capacitance values, or other parameters associated with tunable components 58, thereby tuning antenna 40 to cover desired communications bands.

Signal path 60 may include one or more radio-frequency transmission lines. As an example, signal path 60 of FIG. 3 may be a transmission line having first and second conductive paths such as paths 66 and 68, respectively. Path 66 may be a positive signal line (sometimes referred to herein as signal conductor 66) and path 68 may be a ground signal line (sometimes referred to herein as ground conductor 68). Lines 66 and 68 may form part of a coaxial cable, a stripline transmission line, a microstrip transmission line, an edge-coupled microstrip transmission line, an edge-coupled stripline transmission line, a waveguide structure, a transmission line formed from combinations of these structures, etc. Signal path 60 may sometimes be referred to herein as radio-frequency transmission line 60 or transmission line 60.

Transmission lines in device 10 such as transmission line 60 may be integrated into rigid and/or flexible printed circuit boards if desired. In one suitable arrangement, transmission lines such as transmission line 60 may also include transmission line conductors (e.g., positive signal line 66 and ground signal line 68) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network formed from components such as inductors, resistors, and capacitors may be used in matching the impedance of antenna 40 to the impedance of transmission line 60. Matching network components may be provided as discrete components (e.g., surface mount technology components) or may be formed from housing structures, printed circuit board structures, traces on plastic supports, etc. Matching network components may, for example, be interposed on transmission line 60. The matching network components may be adjusted using control signals received from control circuitry 28 if desired. Components such as these may also be used in forming filter circuitry in antenna 40 (e.g., tunable components 58).

Transmission line 60 may be directly coupled to an antenna resonating element and ground for antenna 40 or may be coupled to near-field-coupled antenna feed structures that are used in indirectly feeding a resonating element for antenna 40. As an example, antenna 40 may be a slot antenna, an inverted-F antenna, a loop antenna, a patch antenna, or other antenna having an antenna feed 62 with a positive antenna feed terminal such as terminal 70 and a ground antenna feed terminal such as terminal 72. Positive signal line 66 may be coupled to positive antenna feed terminal 70 and ground signal line 68 may be coupled to ground antenna feed terminal 72.

If desired, antenna 40 may include an antenna resonating element that is indirectly fed using near-field coupling. In a near-field coupling arrangement, transmission line 60 is coupled to a near-field-coupled antenna feed structure that is used to indirectly feed antenna structures such as the antenna resonating element. This example is merely illustrative and, in general, any desired antenna feeding arrangement may be used.

Figure 4:
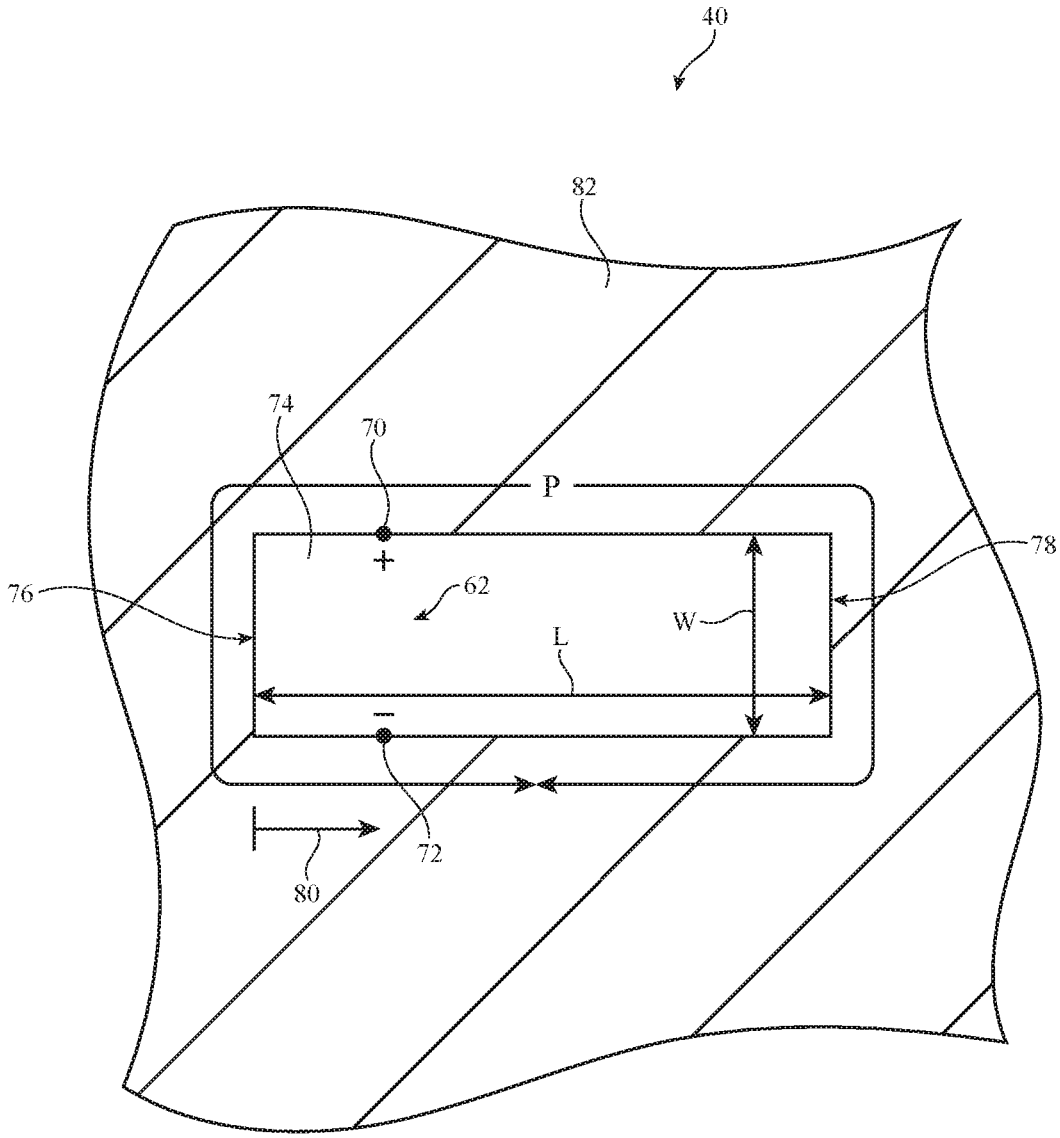
FIG. 4 is a schematic diagram of an illustrative slot antenna in accordance with an embodiment.

Antenna 40 may be formed using any desired antenna structures. In one suitable arrangement, antenna 40 may be formed using a slot antenna structure. An illustrative slot antenna structure that may be used for forming antenna 40 is shown in FIG. 4. As shown in FIG. 4, antenna 40 may include a conductive structure such as conductor 82 that has been provided with a dielectric opening such as dielectric opening 74. Opening 74 may sometimes be referred to herein as slot 74, slot antenna resonating element 74, slot element 74, or slot radiating element 74. In the configuration of FIG. 4, slot 74 is a closed slot, because portions of conductor 82 completely surround and enclose slot 74. Open slot antennas may also be formed in conductive materials such as conductor 82 (e.g., by forming an opening in the right-hand or left-hand end of conductor 82 so that slot 74 protrudes through conductor 82).

Antenna feed 62 for antenna 40 may be formed using positive antenna feed terminal 70 and ground antenna feed terminal 72. In general, the frequency response of an antenna is related to the size and shapes of the conductive structures in the antenna. Slot antennas of the type shown in FIG. 4 tend to exhibit response peaks when slot perimeter P is equal to the wavelength of operation of antenna 40 (e.g. where perimeter P is equal to two times length L plus two times width W). Antenna currents may flow between feed terminals 70 and 72 around perimeter P of slot 74. As an example, where slot length L>>slot width W, the length of antenna 40 will tend to be about half of the length of other types of antennas such as inverted-F antennas configured to handle signals at the same frequency. Given equal antenna volumes, antenna 40 may therefore be able to handle signals at approximately twice the frequency of other antennas such as inverted-F antennas, for example.

Antenna feed 62 may be coupled across slot 74 at a location between opposing edges 76 and 78 of slot 74. For example, antenna feed 62 may be located at a distance 80 from edge 76 of slot 74. Distance 80 may be adjusted to match the impedance of antenna 40 to the impedance of transmission line 60 (FIG. 3). For example, the antenna current flowing around slot 74 may experience an impedance of zero at edges 76 and 78 of slot 74 (e.g., a short circuit impedance) and an infinite (open circuit) impedance at the center of slot 74 (e.g., at a fundamental frequency of the slot). Antenna feed 62 may be located between the center of slot 74 and edge 76 at a location where the antenna current experiences an impedance that matches the impedance of transmission line 60, for example (e.g., distance 80 may be between 0 and ¼ of the wavelength of operation of antenna 40).

The example of FIG. 4 is merely illustrative. In general, slot 74 may have any desired shape (e.g., where the perimeter P of slot 74 defines radiating characteristics of antenna 40). For example, slot 74 may have a meandering shape with different segments extending in different directions, may have straight and/or curved edges, etc. Conductor 82 may be formed from any desired conductive electronic device structures. For example, conductor 82 may include conductive traces on printed circuit boards or other substrates, sheet metal, metal foil, conductive structures associated with display 14 (FIG. 1), conductive portions of housing 12 (e.g., conductive sidewalls 12W of FIG. 1), or other conductive structures within device 10. In one suitable arrangement, different sides (edges) of slot 74 are defined by different conductive structures. For example, one side of slot 74 may be formed from conductive sidewalls 12W whereas the other side of slot 74 is formed from conductive structures associated with display 14.

Figure 5:
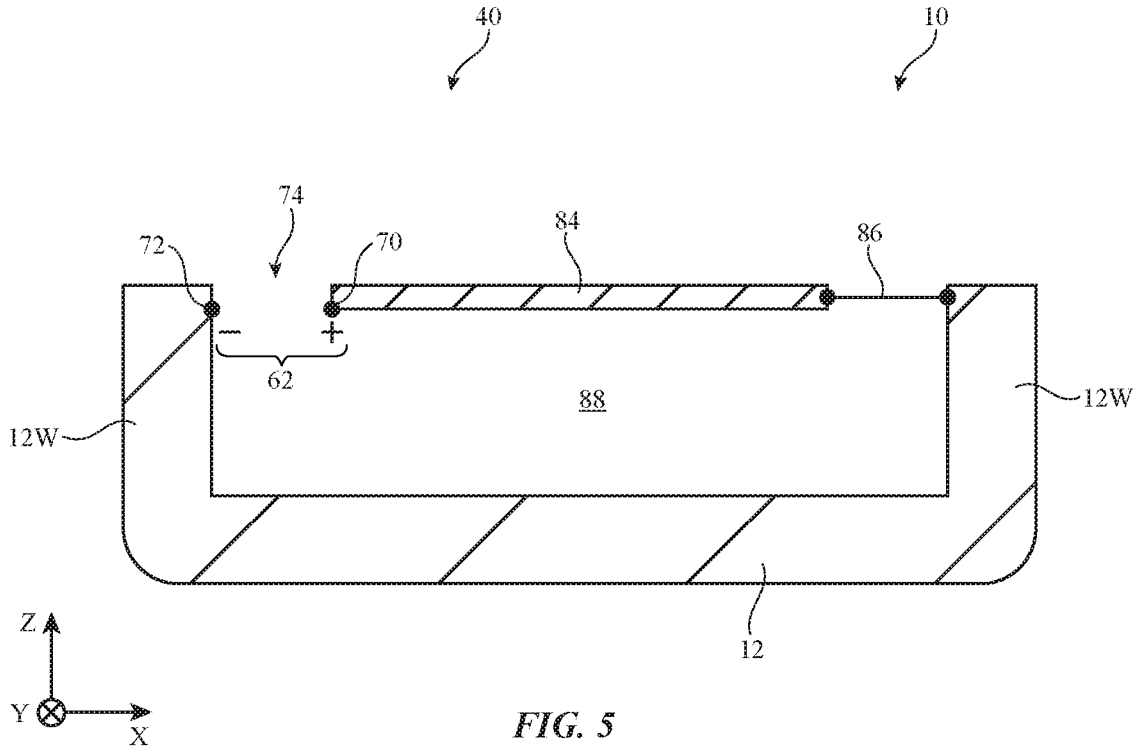
FIG. 5 is a cross-sectional side view of an illustrative antenna formed using conductive display structures and conductive electronic device housing structures in accordance with an embodiment.

FIG. 5 is a simplified cross-sectional side view of device 10 showing how antenna 40 may be formed from conductive structures associated with display 14 and conductive sidewalls 12W. As shown in FIG. 5, antenna 40 may include conductive display structures 84 coupled to an antenna feed such as antenna feed 62. Positive antenna feed terminal 70 of antenna feed 62 may be coupled to conductive display structures 84. Ground antenna feed terminal 72 of antenna feed 62 may be coupled to ground (e.g., to conductive sidewalls 12W of housing 12).

In this way, housing 12 and conductive display structures 84 may form conductor 82 of FIG. 4 and may define the edges of slot 74 for antenna 40 (where the perimeter of slot 74 extends within the X-Y plane of FIG. 5). As shown by FIG. 5, slot 74 may separate conductive display structures 84 from conductive sidewalls 12W and may be bridged by antenna feed 62. Slot 74 may surround one or more lateral sides of conductive display structures 84 (e.g., in the X-Y plane of FIG. 5).

Housing 12 and conductive display structures 84 may define an interior cavity or volume 88 within device 10. Additional device components may be mounted within volume 88. Antenna feed 62 may be coupled to transceiver circuitry 52 by a transmission line such as a coaxial cable or a flexible printed circuit transmission line (e.g., transmission line 60 of FIG. 3).

Conductive display structures 84 may, for example, include portions of display 14 (FIG. 1) such as metal portions of a frame or assembly of display 14, touch sensor electrodes within display 14, portions of a near field communications antenna embedded within display 14, ground plane structures within display 14, a metal back plate for display 14, or other conductive structures on or in display 14. Conductive display structures 84 may sometimes be referred to herein as display module structures 84.

Conductive display structures 84 may be coupled to ground (e.g., conductive sidewall 12W) by conductive interconnect path 86 (e.g., across a portion of slot 74 extending between conductive display structures 84 and conductive sidewalls 12W). Conductive interconnect path 86 may include conductive structures that are directly connected to conductive display structures 84, may include conductive structures that are capacitively coupled to (but not in contact with) conductive display structures 84 (e.g., while still spanning part of slot 74 and electrically shorting conductive display structures 84 to housing 12), and/or may include conductive structures that are not coupled to conductive display structures 84 (e.g., while still spanning part of slot 74 and being held at a ground potential, thereby serving to electrically define the perimeter of slot 74 in the X-Y plane of FIG. 5). In the example of FIG. 5, conductive housing 12 defines a rear wall of device 10 that opposes conductive display structures 84 (e.g., volume 88 may be partially defined by a rear wall of device 10). This is merely illustrative. If desired, some or all of the rear wall of device 10 may be formed from dielectric materials and volume 88 may be defined by other components such as one or more printed circuit boards within device 10.

Antenna 40 may be used to transmit and receive radio-frequency signals in WLAN and/or WPAN bands at 2.4 GHz and 5.0 GHz, in cellular telephone bands between 1.7 GHz and 2.2 GHz and between 2.2 GHz and 2.7 GHz, in an ultra-wideband frequency band between about 5 GHz and 8.3 GHz, in satellite navigation bands at 1.5 GHz, and/or other desired frequency bands. The 2.4 GHz frequency band may include any desired WLAN and/or WPAN frequency bands at frequencies between 2.4 GHz and 2.5 GHz, for example. The 5.0 GHz frequency band may include any desired WLAN frequency bands at frequencies between 4.9 GHz and 5.9 GHz, for example. Additional antennas may also be provided in device 10 to handle these frequency bands and/or other frequency bands. The configuration for antenna 40 of FIG. 5 is merely illustrative.

Figure 6:
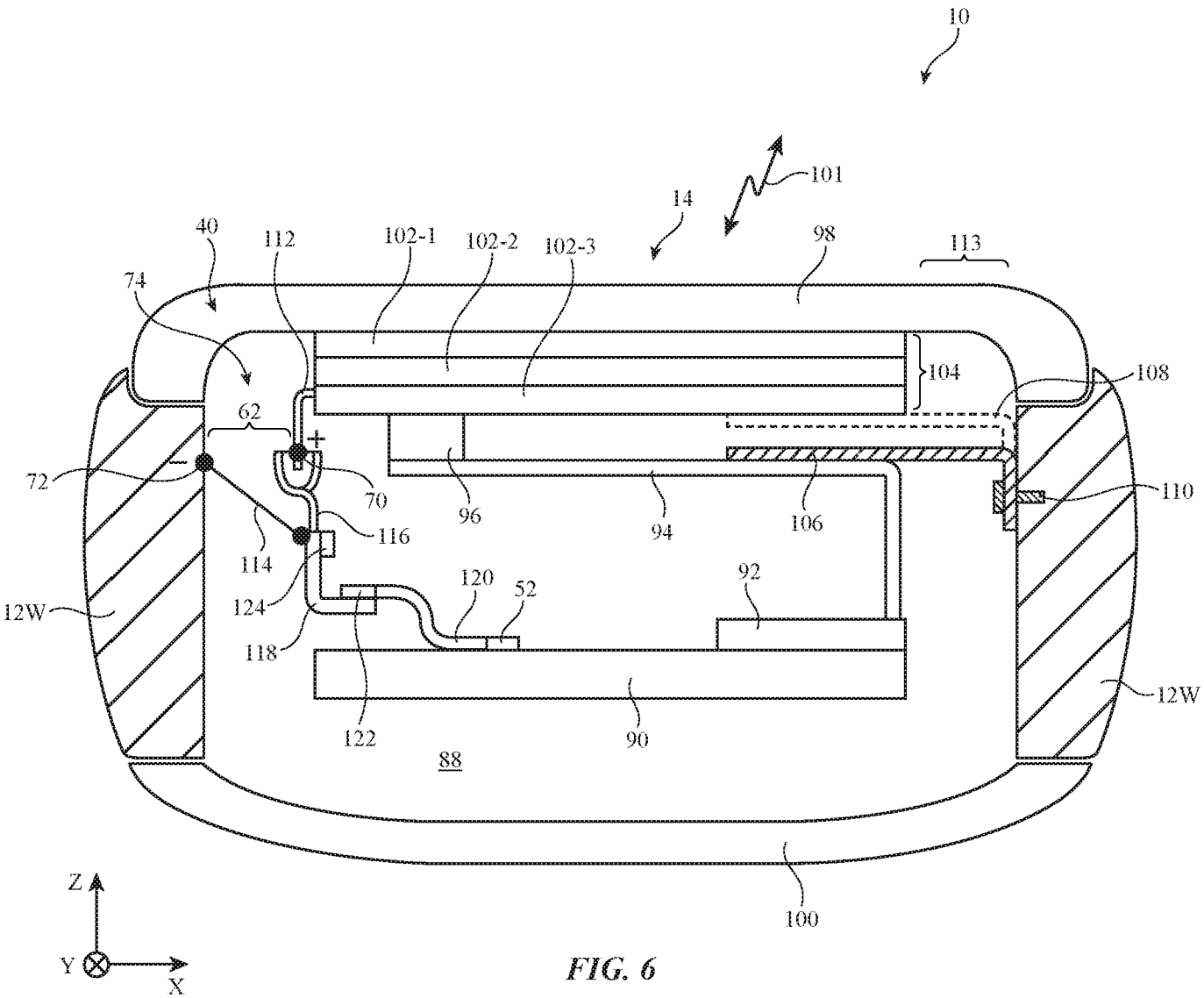
FIG. 6 is a cross-sectional side view of an illustrative electronic device having an antenna of the type shown in FIG. 5 in accordance with an embodiment.

FIG. 6 is a cross-sectional side view of device 10 showing how antenna 40 and conductive interconnect path 86 of FIG.

5 may be implemented within device 10. As shown in FIG. 6, device 10 may have conductive sidewalls 12W that extend from the rear face to the front face of device 10. Housing 12 may include a dielectric rear housing wall such as dielectric rear housing wall 100. Display 14 may be formed at the front face of device 10 whereas dielectric rear housing wall 100 is formed at the rear face of device 10. Conductive sidewalls 12W may be coupled to ground antenna feed terminal 72 of antenna feed 62. Display 14 may include a display cover layer 98 and a display module 104 under display cover layer 98.

Display module 104 may include conductive components that are used in forming conductive display structures 84 of antenna 40 (FIG. 5). The conductive components in display module 104 may, for example, have planar shapes (e.g., planar rectangular shapes, planar circular shapes, etc.) and may be formed from metal and/or other conductive material that carries antenna currents. The thin planar shapes of these components and the stacked configuration of FIG. 7 may, for example, capacitively couple these components to each other so that they may operate together at radio frequencies to form conductive display structures 84 of FIG. 5 (e.g., to effectively/electrically form a single conductor).

The components that form conductive display structures 84 may include, for example, planar components on one or more layers 102 in display module 104 (e.g., a first layer 102-1, a second layer 102-2, a third layer 102-3, or other desired layers). As one example, layer 102-1 may form a touch sensor for display 14, layer 102-2 may form a display panel (sometimes referred to as a display, display layer, or pixel array) for display 14, and layer 102-3 may form a near-field communications antenna for device 10 and/or other circuitry for supporting near-field communications (e.g., at 13.56 MHz). Layer 102-1 may include a capacitive touch sensor and may be formed from a polyimide substrate or other flexible polymer layer with transparent capacitive touch sensor electrodes (e.g., indium tin oxide electrodes), for example. Layer 102-2 may include an organic light-emitting diode display layer or other suitable display layer. Layer 102-3 may be formed from a flexible layer that includes a magnetic shielding material (e.g., a ferrite layer or other magnetic shielding layer) and that includes loops of metal traces. If desired, a conductive back plate, metal shielding cans or layers, and/or a conductive display frame may be formed under and/or around layer 102-3 and may provide structural support and/or a grounding reference for the components of display module 104. Display module 104 may sometimes be referred to herein as display assembly 104.

Conductive material in layers 102-1, 102-2, 102-3, a conductive back plate for display 14, conductive shielding layers, conductive shielding cans, and/or a conductive frame for display 14 may be used in forming conductive structures 84 defining edges of slot 74 for antenna 40. This and/or other conductive material in display 14 used to form conductive display structures 84 may be coupled together using conductive traces, vertical conductive interconnects or other conductive interconnects, and/or via capacitive coupling, for example.

Antenna 40 may be fed using antenna feed 62. Positive antenna feed terminal 70 of antenna feed 62 may be coupled to display module 104 and therefore conductive display structures 84 (e.g., to near-field communications layer 102-3, display layer 102-2, touch layer 102-1, a metal back plate for display module 104, and/or a metal display frame for display module 104). Ground antenna feed terminal 72 of antenna feed 62 may be coupled to an antenna ground in device 10 (e.g., conductive sidewall 12W).

As shown in FIG. 6, device 10 may include printed circuit board structures such as printed circuit board 90. Printed circuit board 90 may be a rigid printed circuit board, a flexible printed circuit board, or may include both flexible and rigid printed circuit board structures. Printed circuit board 90 may sometimes be referred to herein as main logic board 90 or logic board 90. Electrical components such as transceiver circuitry 52, display interface circuitry 92, and other components may be mounted to logic board 90. If desired, one or more additional antennas, coil 50 (FIG. 2), and/or sensor circuitry or other input-output devices may be interposed between logic board 90 and dielectric rear housing wall 100 (e.g., for conveying wireless signals through dielectric rear housing wall 100). Antenna currents for antenna 40 may be conveyed through conductive sidewalls 12W and display module 104 (i.e., conductive display structures 84 of FIG. 5) around the perimeter of slot 74 (e.g., in the X-Y plane of FIG. 7). Corresponding radio-frequency signals may be conveyed through display cover layer 98, as shown by arrow 101.

Display module 104 may include one or more display connectors such as connectors 96. Connectors 96 may be coupled to one or more printed circuits 94. Printed circuits 94 may include flexible printed circuits (sometimes referred to herein as display flexes 94), rigid printed circuit boards, or traces on other substrates if desired. Connectors 96 may convey signals between layers 102 of display module 104 and display interface circuitry 92 on logic board 90 via display flexes 94.

As an example, display module 104 may include a first connector 96 that that conveys touch sensor signals from layer 102-1 to display interface circuitry 92 over a first display flex 94, a second connector 96 that conveys display data (e.g., image data) from display interface circuitry 92 to display layer 102-2 over a second display flex 94 (e.g., layer 102-2 may emit light corresponding to the display data), and a third connector 96 that conveys near field communications signals to and/or from layer 102-3 over a third display flex 94. Connectors 96 may include conductive contact pads, conductive pins, conductive springs, conductive adhesive, conductive clips, solder, welds, conductive wires, and/or any other desired conductive interconnect structures and/or fasteners for conveying data associated with display module 104 between display module 104 and circuitry on logic board 90 or elsewhere in device 10.

Transceiver circuitry 52 may be coupled to antenna feed 62 of antenna 40 over radio-frequency transmission line 60 (FIG. 3). Radio-frequency transmission line 60 may include conductive paths in flexible printed circuit 120 and dielectric support structure 118. Dielectric support structure 118 may, for example, be formed from plastic or other dielectric materials, from a rigid printed circuit board, from a flexible printed circuit, etc. Conductive paths associated with radio-frequency transmission line 60 in flexible printed circuit 120 may be coupled to conductive paths associated with radio-frequency transmission line 60 in dielectric support structure 118 over radio-frequency connector 122.

Ground signal line 68 in transmission line 60 (FIG. 3) may be coupled to ground antenna feed terminal 72 over path 114 (e.g., ground traces in dielectric support structure 118 may be coupled to ground antenna feed terminal 72 over path 114). Path 114 may include conductive wire, conductive adhesive, conductive fasteners such as screws, conductive pins, conductive clips, conductive brackets, solder, welds, and/or any other desired conductive interconnect structures. Signal line 66 of transmission line 60 (FIG. 3) may be coupled to positive antenna feed terminal 70 of antenna 40 over conductive clip 116 (e.g., signal traces in dielectric support structure 118 may be coupled to positive antenna feed terminal 70 over conductive clip 116). One or more components such as components 124 may be mounted to dielectric support structure 118 if desired. Components 124 may include amplifier circuitry, impedance matching circuitry, or any other desired components.

If desired, a conductive tab or blade such as conductive tab 112 may be coupled to the conductive structures of display module 104 (e.g., conductive structures in layers 102, a conductive back plate, a conductive frame, conductive shielding cans or layers, and/or other conductive display structures 84 in display module 104). Clip 116 may mate with tab 112 to form an electrical connection between transmission line 60 and positive antenna feed terminal 70 (e.g., positive antenna feed terminal 70 may be located on tab 112 when clip 116 is attached to tab 112). Clip 116 may, for example, be a tulip clip or other clip that has prongs or other structures that exerts pressure towards tab 112, thereby ensuring that a robust and reliable electrical connection is held between tab 112 and clip 116 over time.

When configured in this way, antenna currents may be conveyed over antenna feed 62 and may begin to flow around the perimeter of slot 74 (e.g., in the X-Y plane of FIG. 6). In order to help define the lateral (elongated) length L of slot 74, conductive interconnect paths such as conductive interconnect path 86 of FIG. 5 may span gap 113 between a given side of display module 104 and an adjacent conductive sidewall 12W. In the example of FIG. 6, conductive interconnect path 86 of FIG. 5 is implemented using conductive interconnect structures 106. Conductive interconnect structures 106 may sometimes be referred to herein as conductive grounding structures 106 or grounding structures 106.

In one suitable arrangement, conductive interconnect structures 106 may be shorted to (e.g., in direct contact with) the conductive material in display module 104, as shown by dashed lines 108. For example, conductive interconnect structures 106 may be shorted to conductive material within layer 102-1, layer 102-2, or layer 102-3, a conductive frame of display module 104, a conductive back plate of display module 104, shielding structures in display module 104, and/or other conductive material in display module 104 that are used to form conductive display structures 84 of antenna 40.

If desired, conductive adhesive or conductive fastening structures such as pins, solder, welds, springs, screws, clips, brackets, and/or other fastening structures may be used to ensure that conductive interconnect structures 106 are held in contact with conductive material in display module 104. Conductive interconnect structures 106 may extend across gap 113 and may be shorted to conductive sidewall 12W. Conductive interconnect structures 106 may be held into contact with conductive sidewall 12W using conductive adhesive, pins, springs, screws, clips, brackets, solder, welds, and/or other structures if desired. In the example of FIG. 6, a conductive screw 110 fastens conductive interconnect structures 106 to conductive sidewall 12W and serves to electrically short conductive interconnect structures 106 and thus conductive display structures 84 to conductive sidewall 12W.

When configured in this way, conductive interconnect structures 106 may define a portion of the perimeter of slot 74 in antenna 40 (e.g., in the X-Y plane of FIG. 6), thereby partially defining length L of slot 74 (FIG. 4). In addition, conductive interconnect structures 106 (e.g., conductive interconnect path 86 as shown in FIG. 5) may form a short circuit path between conductive material in display module 104 and conductive sidewall 12W (e.g., antenna currents for antenna 40 may flow over conductive interconnect structures 106 between display module 104 and conductive sidewall 12W). Shorting display module 104 to conductive sidewall 12W across gap 113 may serve to mitigate excessively strong electric fields that would otherwise be present in the vicinity of gap 113 due to the location of antenna feed 62 on a different side of display module 104. This may serve to optimize antenna efficiency relative to scenarios where display module 104 is completely isolated from conductive sidewalls 12W, for example.

This example is merely illustrative. Conductive interconnect structures 106 need not directly contact display module 104. In another suitable arrangement, conductive interconnect structures 106 may span gap 113 without directly contacting display module 104 (e.g., as shown in FIG. 6). In this scenario, conductive interconnect structures 106 may be electrically shorted to one or more display flexes 94 (e.g., to ground conductors or other conductive material in display flexes 94). For example, conductive interconnect structures 106 may be electrically shorted to display flexes 94 using conductive adhesive or conductive fastening structures such as pins, solder, welds, springs, screws, clips, brackets, and/or other structures that ensure that conductive interconnect structures 106 are held in contact with display flexes 94.

If desired, conductive interconnect structures 106 may be located sufficiently close to the conductive material in display module 104 so as to effectively short conductive display structures 84 to ground (e.g., at radio-frequencies handled by antenna feed 62). For example, conductive interconnect structures 106 may be capacitively coupled to conductive display structures 84 in display module 104 and antenna currents associated with antenna 40 may flow between display module 104 and conductive sidewall 12W over conductive interconnect structures 106 (e.g., via capacitive coupling). Conductive interconnect structures 106 need not be shorted to display flexes 94 in this scenario, if desired. Conductive interconnect structures 106 may directly contact one, both, or neither of display module 104 and display flexes 94. Conductive interconnect structures 106 may be capacitively coupled to one, both, or neither of display module 104 and display flexes 94.

In another suitable arrangement, conductive interconnect structures 106 may be located far enough away from display module 104 so that conductive interconnect structures 106 are not capacitively coupled to the conductive material in display module 104. In this scenario, because conductive interconnect structures 106 are held at a ground potential (e.g., because conductive interconnect structures 106 short ground structures in display flexes 94 to the grounded conductive sidewall 12W), conductive interconnect structures 106 may still electrically define edges of slot 74 despite not actually being in contact with or capacitively coupled to conductive display structures 84 in display module 104, thereby helping to define length L of slot 74 (FIG. 4).

The example of FIG. 6 is merely illustrative. In general, conductive sidewalls 12W, cover layer 98, and dielectric rear housing wall 100 may have any desired shapes. Additional components may be formed within volume 88 if desired. A substrate or other support structure may be interposed between logic board 90 and display flexes 94 if desired (e.g., to hold display flexes 94 in place). Other arrangements may be used if desired. If desired, flexible printed circuit 120 may be coupled to antenna feed 62 without dielectric support structure 118 or flexible printed circuit 120 may be omitted (e.g., dielectric support structure 118 may be coupled directly to transceiver circuitry 52). Other transmission line and feeding structures may be used if desired.

Figure 7:
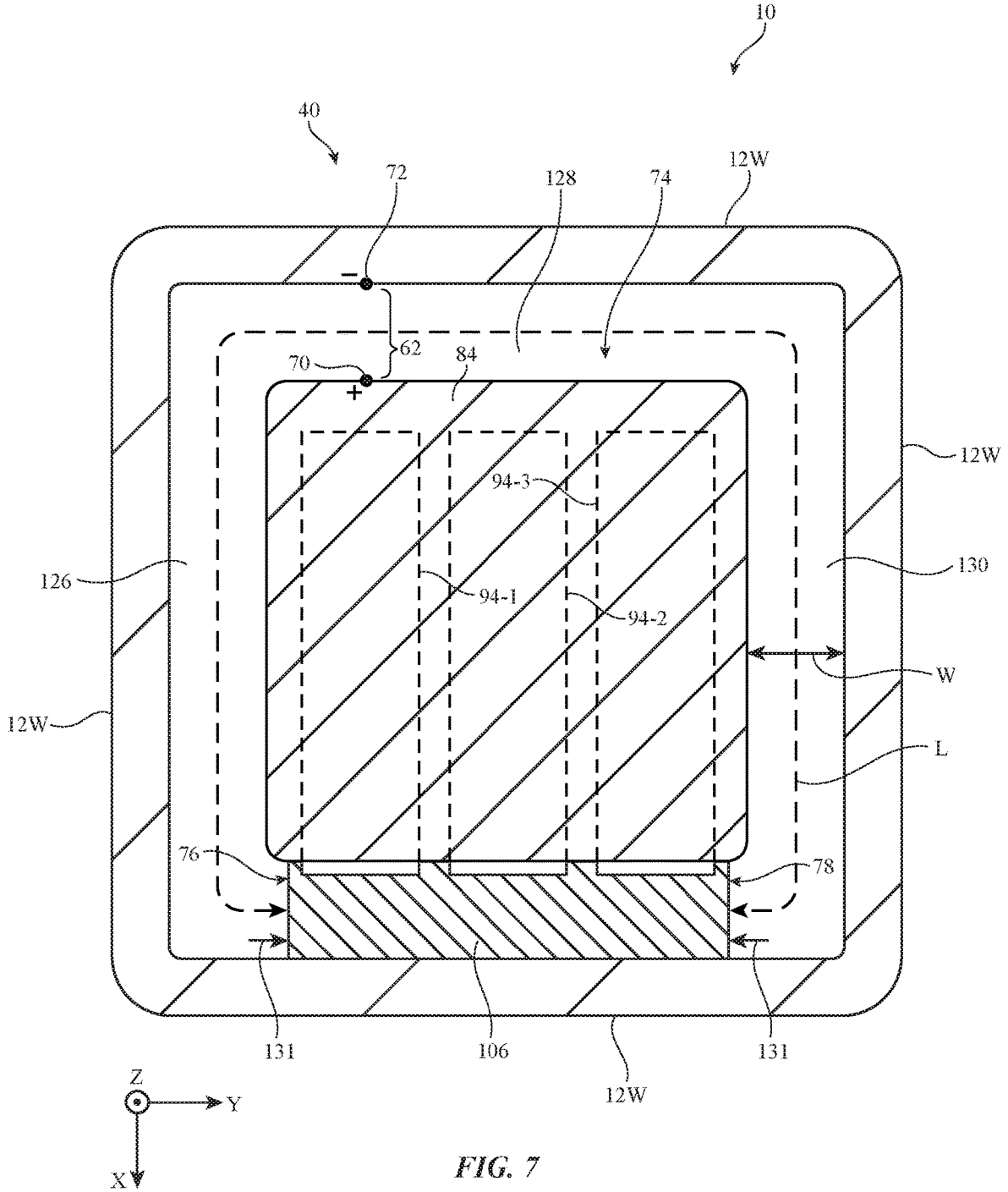
FIG. 7 is a top-down view an illustrative antenna formed using conductive display structures that are grounded to conductive electronic device housing structures in accordance with an embodiment.

FIG. 7 is a top-down view showing how slot 74 of antenna 40 may follow a meandering path around display module 104 and may have edges defined by display module 104, conductive sidewalls 12W, and conductive interconnect structures 106. The plane of the page in FIG. 7 may, for example, lie in the X-Y plane of FIGS. 5 and 6. In the example of FIG. 7, display cover layer 98 of FIG. 6 is not shown for the sake of clarity.

As shown in FIG. 7, slot 74 of antenna 40 may follow a meandering path and may have edges defined by different conductive electronic device structures. For example, slot 74 may have a first set of edges (e.g., outer edges) defined by conductive sidewalls 12W and a second set of edges (e.g., inner edges) defined by conductive structures such as conductive display structures 84. Conductive display structures 84 may, for example, include conductive portions of display module 104 (FIG. 6) such as metal portions of a frame or assembly of display 14, touch sensor electrodes within layer 102-1, pixel circuitry within layer 102-2, portions of a near field communications antenna embedded within layer 102-3, ground plane structures within display 14, a metal back plate for display 14, or other conductive structures on or in display 14.

In the example of FIG. 7, slot 74 follows a meandering path and has a first segment 126 extending between edge the left conductive sidewall 12W and conductive display structures 84, a second segment 128 extending between the top conductive sidewall 12W and conductive display structures 84, and a third segment 130 extending between the right conductive sidewall 12W and conductive display structures 84. Segments 126 and 130 may extend along parallel longitudinal axes. Segment 128 may extend between ends of segments 126 and 130 (e.g., perpendicular to the longitudinal axes of segments 126 and 130). In this way, slot 74 may be an elongated slot that extends between conductive display structures 84 and multiple conductive sidewalls 12W (e.g., to maximize the length of slot 74 for covering relatively low frequency bands such as satellite navigation communications bands and low band cellular telephone communications bands).

Antenna 40 may be fed using antenna feed 62 coupled across width W of slot 74. In the example of FIG. 7, antenna feed 62 is coupled across segment 128 of slot 74. This is merely illustrative and, in general, antenna feed 62 may be coupled across any desired portion of slot 74. Ground antenna feed terminal 72 of antenna feed 62 may be coupled to a given conductive sidewall 12W and positive antenna feed terminal 70 of antenna feed 62 may be coupled to conductive display structures 84. This is merely illustrative and, if desired, ground antenna feed terminal 72 may be coupled to conductive display structures 84 and positive antenna feed terminal 70 may be coupled to conductive sidewall 12W.

When configured in this way, slot 74 may have length L defined by the cumulative lengths of segments 126, 128, and 130. The perimeter of slot 74 may be defined by the sum of the lengths of the edges of these segments. Antenna 40 may, for example, exhibit response peaks when the perimeter of slot 74 is approximately equal to the effective wavelength of operation of the antenna (e.g., the wavelength after accounting for dielectric effects associated with the materials in device 10). Antenna feed 62 may convey antenna currents around the perimeter of slot 74 (e.g., over conductive sidewalls 12W and conductive display structures 84). The antenna currents may generate corresponding wireless signals that are transmitted by antenna 40 or may be generated in response to corresponding wireless signals received by antenna 40 from external equipment.

Conductive interconnect structures 106 may define opposing edges 76 and 78 of slot 74 and may serve to effectively define the length L of slot 74. Conductive interconnect structures may be held at a ground potential and/or may short conductive display structures 84 to conductive sidewall 12W. When configured in this way, antenna currents conveyed by antenna feed 62 may experience a short circuit impedance at ends 76 and 78 of slot 74 (over conductive interconnect structures 106).

If desired, the location and width of conductive interconnect structures 106 may be adjusted (e.g., as shown by arrows 131) to extend or contract the length L of slot 74 (e.g., so that slot 74 radiates at desired frequencies). In one suitable arrangement, antenna 40 may be provided with suitable impedance matching circuitry and a selected length L so that slot 74 radiates in a first frequency band (e.g., a first frequency band from 1.5 GHz to 2.2 GHz that covers WLAN, WPAN, satellite navigation, cellular midband, and/or some cellular high band frequencies), a second frequency band (e.g., a second frequency band from 2.2 GHz to 3.0 GHz that covers WLAN/WPAN frequencies), and a third frequency band (e.g., a third frequency band from 5.0 to 8.0 GHz that covers WLAN frequencies and UWB frequencies). One or more of these frequency bands may be covered by harmonic modes of slot 74 if desired. Conductive interconnect structures 106 may be directly connected to conductive display structures 84 (e.g., as shown by dashed lines 108 of FIG. 6), may be indirectly coupled to conductive display structures 106 via capacitive coupling, or may be separated from conductive display structures 106 (e.g., conductive interconnect structures 106 need not be in contact with conductive display structures 84 to electrically define part of the perimeter of slot 74).

In scenarios where conductive interconnect structures 106 are absent from device 10, excessively strong electric fields may be generated between conductive display structures 84 and the conductive sidewall 12W at the side of device 10 opposite to antenna feed 62. These fields may limit the overall antenna efficiency of antenna 40. However, the presence of conductive interconnect structures 106 may effectively form a short circuit between conductive display structures 84 and conductive sidewall 12W. This may, for example, configure housing 12 and conductive display structures 84 to electrically behave as a single metal body, mitigating excessive electric fields at the side of device 10 opposing antenna feed 62. In this way, antenna 40 may operate with greater antenna efficiency relative to scenarios where conductive interconnect structures 106 are absent from device 10. The presence of conductive interconnect structures 106 may allow for the width W of slot 74 and the thickness of device 10 to be reduced given equal antenna efficiencies relative to scenarios where conductive interconnect structures 106 are not formed within device 10, for example.

Conductive interconnect structures 106 may include any desired conductive structures such as conductive adhesive (e.g., conductive tape), conductive fasteners (e.g., conductive screws or clips such as blade clips), conductive pins, solder, welds, conductive traces on flexible printed circuits, metal foil, stamped sheet metal, integral device housing structures, conductive brackets, conductive springs, and/or any other desired structures for defining the perimeter of slot 74 and/or effectively forming an electrical short circuit path between conductive display structures 84 and housing 12.

As shown in FIG. 7, multiple display flexes 94 may be formed under conductive display structures 84 (e.g., a first display flex 94-1, a second display flex 94-2, and a third display flex 94-3). Display flex 94-3 may be electrically coupled to layer 102-3 (FIG. 6), display flex 94-2 may be electrically coupled to layer 102-2, and display flex 94-1 may be electrically coupled to layer 102-1. The ends of display flexes 94 closest to antenna feed 62 may be coupled to conductive display structures 84, for example. The opposing ends of display flexes 94 may be coupled to display interface circuitry 92 (FIG. 6). Display flex 94-3 may convey near field communications signals between layer 102-3 and other communications circuitry on logic board 90. Display flex 94-2 may convey image data between layer 102-2 and display circuitry on logic board 90. Display flex 94-1 may convey touch sensor data between layer 102-1 and control circuitry on logic board 90. Conductive interconnect structures 106 may electrically short grounded portions of display flexes 94-1, 94-2, and 94-3 to conductive sidewalls 12W if desired.

The example of FIG. 7 is merely illustrative. Slot 74 may have a uniform width W along length L or may have different widths along length L. If desired, width W may be adjusted to tweak the bandwidth of antenna 40. As an example, width W may be between 0.5 mm and 1.0 mm. Slot 74 may have other shapes if desired (e.g., shapes with more than three segments extending along respective longitudinal axes, fewer than three segments, curved edges, etc.).

Figure 8:
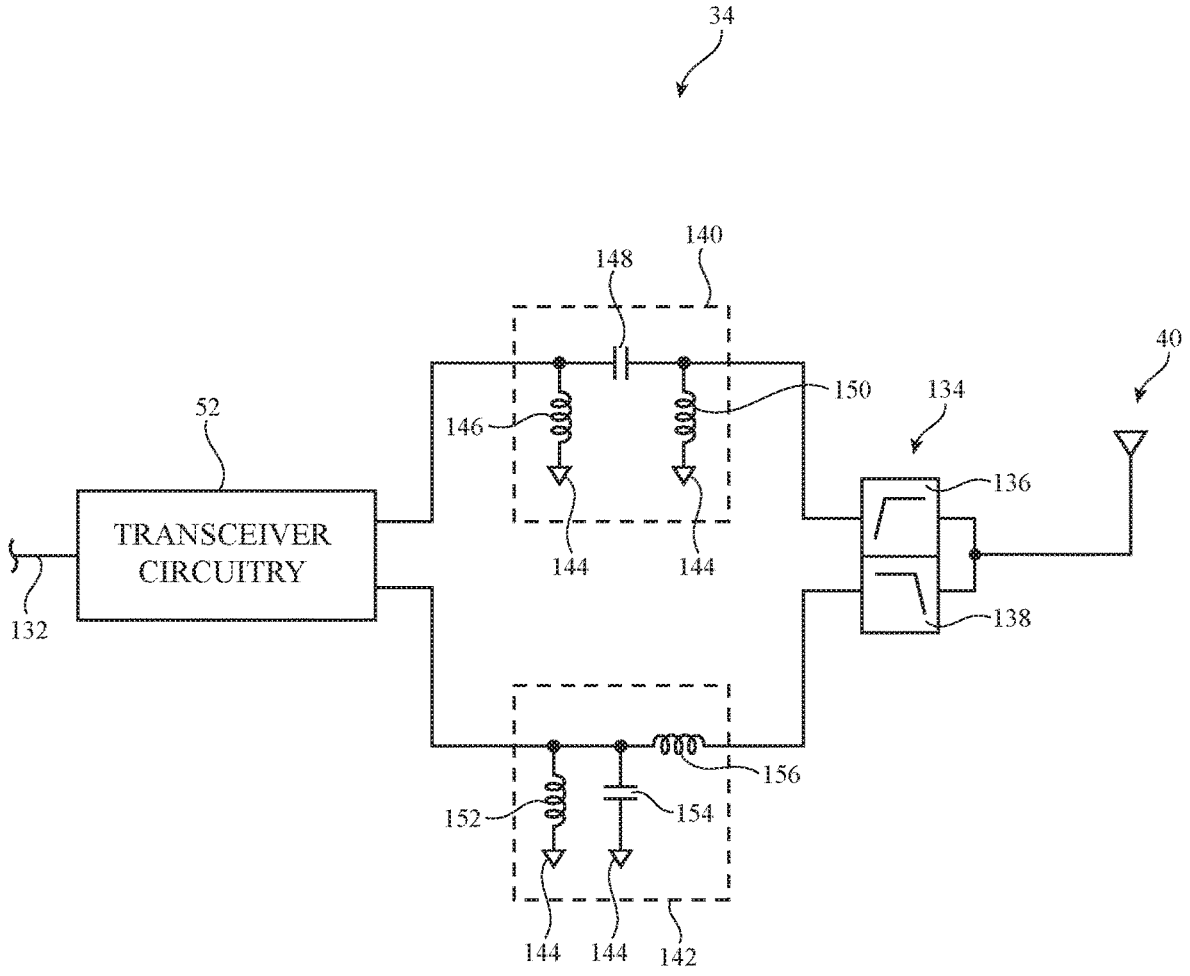
FIG. 8 is a circuit diagram of illustrative wireless circuitry having separate low band and high band matching circuits for performing wireless operations across multiple frequency bands in accordance with an embodiment.

Impedance matching circuitry may be coupled to antenna 40 to optimize antenna efficiency for antenna 40 across multiple different frequency bands of interest. In practice, it can be difficult to provide impedance matching circuitry with satisfactory bandwidth for impedance matching in the UWB band from 5.0 GHz to 8.3 GHz in addition to WLAN, WPAN, GPS, and cellular bands at lower frequencies. FIG. 8 is a circuit diagram showing how antenna 40 may be provided with impedance matching circuitry that supports communications across these frequencies.

As shown in FIG. 8, transceiver circuitry 52 may be coupled to antenna 40 through filter circuitry such as diplexer circuitry 134 and impedance matching circuitry such as high band impedance matching circuitry 140 and low band impedance matching circuitry 142. Low band impedance matching circuitry 142 and high band impedance matching circuitry 140 may be coupled in parallel between transceiver circuitry 52 and diplexer circuitry 134, for example. During wireless operations, transceiver circuitry 52 may receive data for transmission over data path 132 (e.g., baseband data received from baseband circuitry or control circuitry 28 of FIG. 2). Transceiver circuitry 52 may up-convert the data and may transmit the data over antenna 40. Similarly, antenna 40 may receive radio-frequency signals and may convey the radio-frequency signals to transceiver circuitry 52. Transceiver circuitry 52 may down-convert the received radio-frequency signals to baseband frequencies and may output the down-converted signals on data path 132.

Diplexer circuitry 134 may separate radio-frequency signals at relatively low frequencies such as frequencies in the cellular midband, the cellular high band, the GPS band, and 2.4 GHz WLAN/WPAN bands from radio-frequency signals at relatively high frequencies such as frequencies in the 5.0 GHz WLAN band and the UWB band. As one example, diplexer circuitry 134 may include a high pass filter 136 and a low pass filter 138. High pass filter 136 may block radio-frequency signals in the cellular midband, the cellular high band, the GPS frequency band, and the 2.4 GHZ WLAN/WPAN frequency bands while passing radio-frequency signals in the 5.0 GHZ WLAN band and the UWB band. Low pass filter 138 may pass radio-frequency signals in the cellular midband, the cellular high band, the GPS frequency band, and the 2.4 GHZ WLAN/WPAN frequency bands while blocking radio-frequency signals in the 5.0 GHZ WLAN band and the UWB band.

High band impedance matching circuitry 140 may perform impedance matching for antenna 40 at relatively high frequencies such as frequencies in the 5.0 GHz WLAN band and/or the UWB band. In the example of FIG. 8, high band impedance matching circuitry 140 includes a capacitor 148 coupled in series between transceiver circuitry 52 and high pass filter 136, a first inductor 146 coupled between a first side of capacitor 148 and ground 144, and a second inductor 150 coupled between a second side of capacitor 148 and ground 144. This is merely illustrative and, in general, high band impedance matching circuitry 140 may include any desired resistive, capacitive, and/or inductive components arranged in any desired manner.

Low band impedance matching circuitry 142 may perform impedance matching for antenna 40 at relatively low frequencies such as frequencies in the cellular midband, the cellular high band, the GPS frequency band, and/or 2.4 GHz WLAN/WPAN frequency bands. In the example of FIG. 8, low band impedance matching circuitry 142 includes a first inductor 156 coupled in series between transceiver circuitry 52 and low pass filter 138, a capacitor 154 coupled between a first side of first inductor 156 and ground 144, and a second inductor 152 coupled between the first side of first inductor 156 and ground 144. This is merely illustrative and, in general, low band impedance matching circuitry 142 may include any desired resistive, capacitive, and/or inductive components arranged in any desired manner.

Separately matching antenna 40 for relatively low and relatively high frequencies using low band impedance matching circuitry 142 and high band impedance matching circuitry 140 in this way may extend the range of frequencies over which antenna 40 can be satisfactorily matched to transceiver circuitry 52 (and transmission line 60 of FIG. 3). This may effectively extend the bandwidth of the impedance matching circuitry for antenna 40 to include frequencies from the GPS frequency band through the UWB frequency band, thereby ensuring that antenna 40 operates with satisfactory antenna efficiency across each frequency band of interest.

Figure 9:
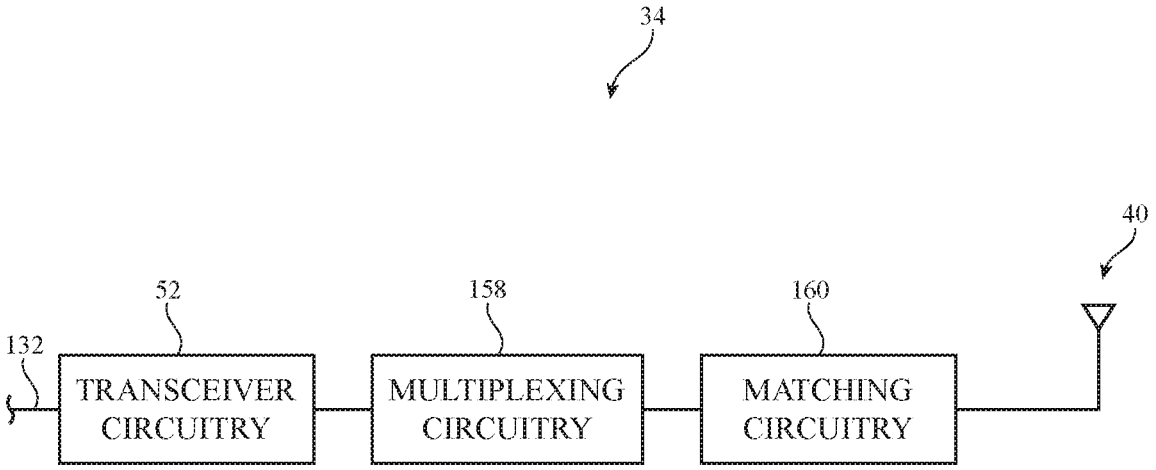
FIG. 9 is a circuit diagram of illustrative wireless circuitry having shared matching circuitry for performing wireless operations across multiple frequency bands in accordance with an embodiment.

The example of FIG. 8 is merely illustrative. In another suitable arrangement, the same matching circuitry may be used for covering each frequency band of interest for antenna 40. FIG. 9 is a circuit diagram showing how the same matching circuitry may be used for covering each frequency band of interest for antenna 40.

As shown in FIG. 9, wireless circuitry 34 may include multiplexing circuitry 158 and matching circuitry 160 coupled between transceiver circuitry 52 and antenna 40. Matching circuitry 160 may include components for impedance matching antenna 40 from relatively low frequencies such as frequencies in the GPS frequency band to relatively high frequencies such as frequencies in the UWB frequency band. Multiplexing circuitry 158 may include switching circuitry, filter circuitry, or other desired multiplexing circuitry for multiplexing radio-frequency signals at relatively low frequencies with radio-frequency signals at relatively high frequencies onto antenna 40. If desired, transceiver circuitry 52 and multiplexing circuitry 158 may be formed on a shared (common) integrated circuit, printed circuit board, substrate, or package.

Figure 10:
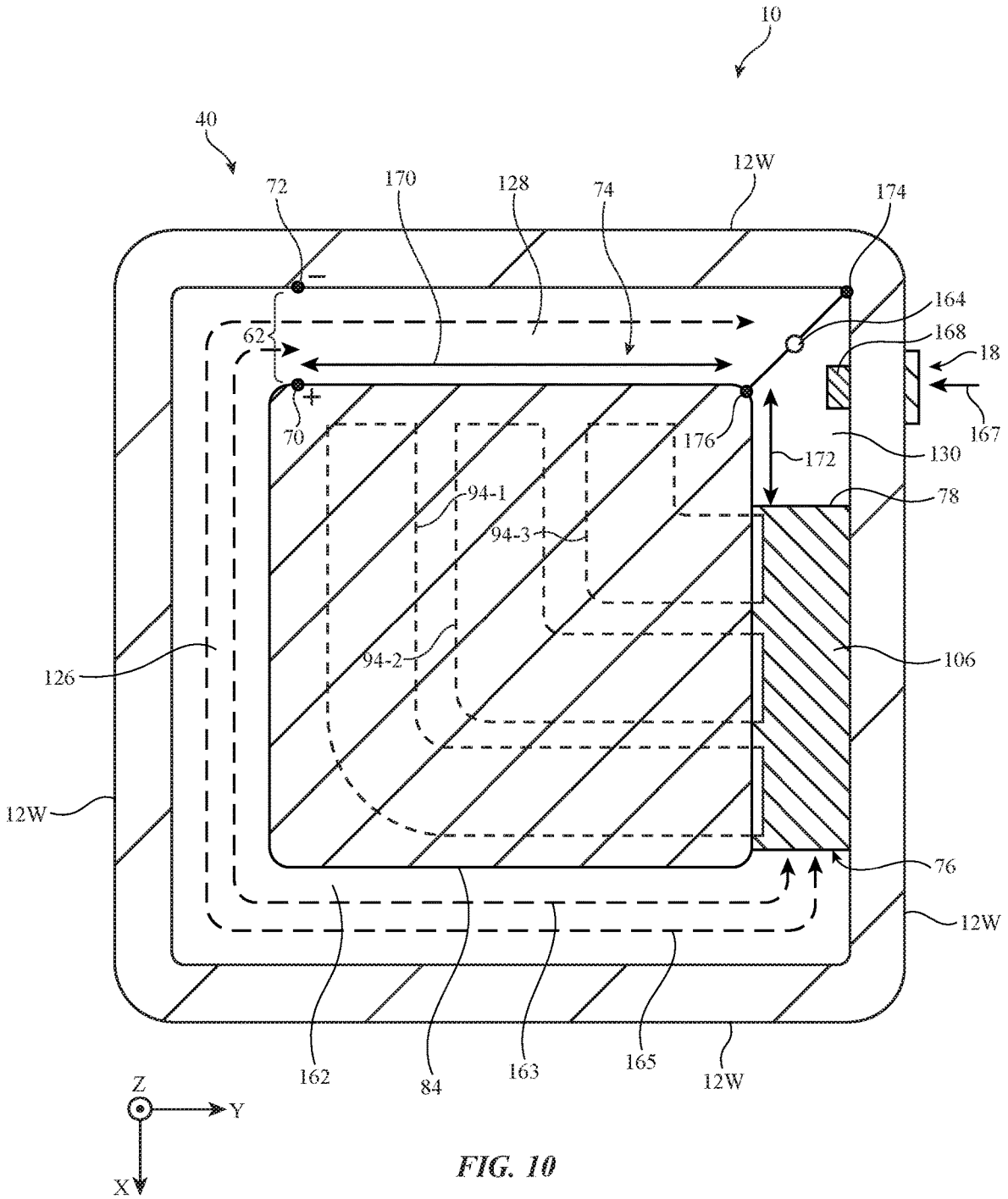
FIG. 10 is a top-down view an illustrative antenna formed using conductive display structures that are coupled to conductive electronic device housing structures using an antenna tuning component and conductive grounding structures in accordance with an embodiment.

In this scenario, antenna 40 may be provided with tuning components (e.g., tunable components 58 of FIG. 3) to recover satisfactory antenna efficiency across all the frequency bands of operation for antenna 40 (e.g., frequencies from the GPS frequency band through the UWB frequency band). FIG. 10 is a top-down view showing how antenna 40 may be provided with tuning components for covering these frequencies of operation. The plane of the page in FIG. 10 may, for example, lie in the X-Y plane of FIGS. 5 and 6. In the example of FIG. 10, display cover layer 98 of FIG. 6 is not shown for the sake of clarity.

As shown in FIG. 10, conductive interconnect structures 106 may couple conductive display structures 84 to conductive sidewalls 12W across segment 130 of slot 74. When configured in this way, slot 74 has a fourth segment 162 at the side of conductive display structures 84 opposite to segment 128 of slot 74. This may extend the physical length of slot 74 to include segments 162, 126, 128, and a portion of segment 130. In this scenario, display flexes 94-1, 94-2, and 94-3 may follow curved paths from the side of conductive display structures 84 adjacent to segment 128 of slot 74 to the location of conductive interconnect structures 106 (e.g., so that display flexes 94 are still shorted to conductive sidewall 12W through conductive interconnect structures 106).

An antenna tuning component such as tuning component 164 may be coupled across the width of slot 74. Tuning component 164 may have a first terminal 176 coupled to conductive display structures 84 at a location along slot 74 that is interposed between positive antenna feed terminal 70 and conductive interconnect structures 106. Terminal 176 may be separated from conductive interconnect structures 106 along the edge of slot 74 by distance 172. Terminal 176 may be separated from positive antenna feed terminal 70 along the edge of slot 74 by distance 170. Tuning component 164 may have a second terminal 174 that is coupled to conductive sidewalls 12W. Button (crown) 18 of device 10 may be coupled to conductive sidewalls 12W at a location between tuning component 164 and conductive interconnect structures 106. Button 18 may include conductive button assembly structures 168 that lie within segment 130 of slot 74 (e.g., conductive button assembly structures 168 may define part of the edge of slot 74).

Tuning component 164 may include any desired fixed or adjustable inductive, resistive, and/or capacitive components arranged in any desired manner between terminals 176 and 174. Tuning component 164 may include an actively adjustable (tunable) component such as an adjustable inductor having an inductance that is dynamically adjusted by control circuitry 28 (FIG. 2) if desired. In this scenario, control circuitry 28 may adjust the inductance of tuning component 164 in real time to tune the frequency response of antenna 40.

Antenna 40 of FIG. 10 may have a first radiative mode associated with the length 165 of slot 74 extending from edge 76 to tuning component 164. Length 165 may be sufficiently long to cover communications at relatively low frequencies such as frequencies in the GPS frequency band, the cellular midband, and the cellular high band (e.g., length 165 may be selected to support satisfactory antenna efficiency at these frequencies). Tuning component 164 may appear as a short circuit path across the width of slot 74 for antenna current conveyed by antenna feed 62 at these relatively low frequencies (thereby effectively defining an edge of slot 74 that opposes edge 76).

Tuning component 164 may appear as a tuning inductance (e.g., in scenarios where tuning component 164 includes an inductor) for antenna current conveyed by antenna feed 62 at relatively high frequencies such as frequencies in 2.4 GHz WLAN/WPAN frequency band. At these relatively high frequencies, antenna 40 may exhibit a second radiative mode associated with the length 163 of slot 74 extending from antenna feed 62 to edge 76 (e.g., length 163 may be selected to support satisfactory antenna efficiency at these frequencies). One or more harmonic modes associated with length 163 of slot 74 may allow antenna 40 to cover even higher frequencies such as frequencies in the 5.0 GHz WLAN frequency band and the UWB frequency band. The location of antenna feed 62 (e.g., distance 170), the location of tuning component 164 (e.g., distance 172), and the impedance (e.g., inductance) of tuning component 164 may be selected to tweak the frequency response of antenna 40 to provide coverage in any desired frequency bands with satisfactory antenna efficiency.

In the absence of tuning component 164, antenna 40 may be limited to covering relatively low frequencies such as frequencies in the GPS frequency band, the cellular midband, and the cellular high band. By forming tuning component 164 within antenna 40, antenna 40 may continue to operate at these relatively low frequencies (e.g., from a fundamental mode associated with length 165) while also supporting communications in the 2.4 GHz WLAN/WPAN band (e.g., from a fundamental mode associated with length 163) and in the 5.0 GHz WLAN and UWB bands (e.g., from one or more harmonic modes associated with length 163). In this way, antenna 40 may operate with satisfactory antenna efficiency across each of these frequency bands while using the same matching circuitry 160 (FIG. 9) for each band. This may, for example, reduce the area and manufacturing cost required to form separate matching circuits such as low band impedance matching circuitry 142 and high band impedance matching circuitry 140 of FIG. 8.

The example of FIG. 10 is merely illustrative. In general, tuning component 164 may be coupled across any desired segment of slot 74. Button 18 may be mounted to any desired conductive sidewall 12W. Antenna feed 62 may be coupled across any desired segment of slot 74. Additional conductive interconnect structures 106 may be coupled across slot 74 if desired. While device 10 is shown having a rectangular outline in FIG. 10, device 10 may have any desired shape. Slot 74 may have additional segments or may follow other desired paths. Any desired number of display flexes 94 may be coupled to conductive interconnect structures 106. One or more parasitic antenna resonating elements may be mounted over or otherwise electromagnetically coupled to slot 74 for adjusting the frequency response and bandwidth of antenna 40.

Figure 11:
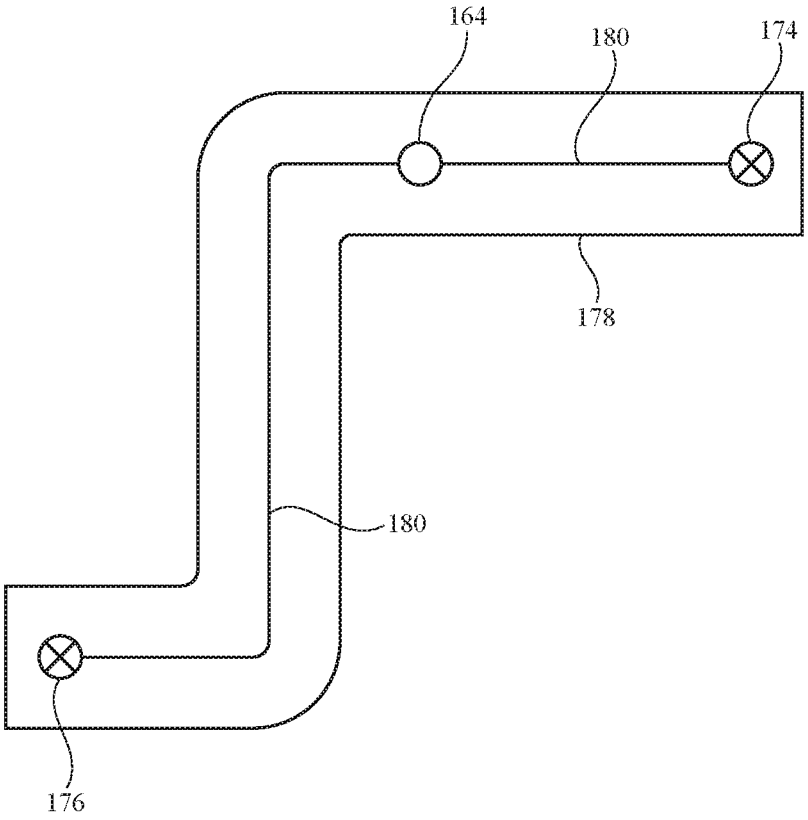
FIG. 11 is a top-down view of an illustrative antenna tuning component formed on a flexible printed circuit for coupling conductive display structures to conductive electronic device housing structures in accordance with an embodiment.

FIG. 11 is a top-down view showing how tuning component 164 may be mounted to a substrate. As shown in FIG. 11, tuning component 164 may be mounted to a substrate such as substrate 178. Substrate 178 may be a plastic substrate, a ceramic substrate, a glass substrate, a rigid printed circuit board substrate, a flexible printed circuit substrate, or any other desired substrate. Tuning component 164 may be coupled to terminal 176 via conductive traces 180 on substrate 178. Tuning component 164 may be coupled to terminal 174 via conductive traces 180 on substrate 178. Substrate 178 may have a shape that allows substrate 178 to conform to the shape of other components in device 10 and/or to allow substrate 178 to bend along any desired axes for coupling tuning component 164 across slot 74. The example of FIG. 11 is merely illustrative. In general, any desired number of tuning components may be mounted to flexible printed circuit substrate 178 and coupled in any desired manner between terminals 176 and 174.

Figure 12:
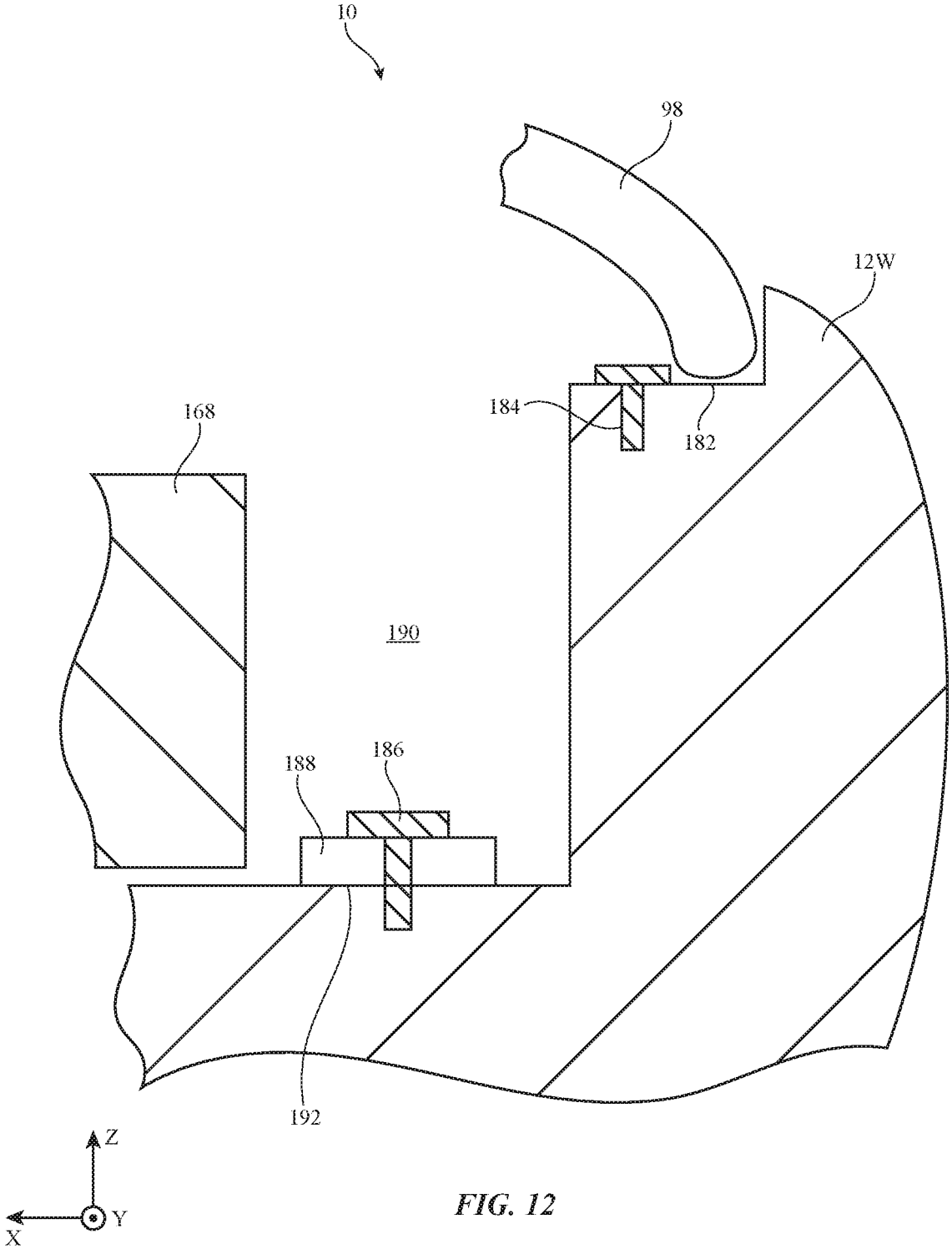
FIG. 12 is a cross-sectional side view of an illustrative electronic device showing how a flexible printed circuit of the type shown in FIG. 11 may be coupled to conductive electronic device housing structures in accordance with an embodiment.

FIG. 12 is a cross-sectional side view of device 10 showing how tuning component 164 may be coupled to housing 12 (e.g., as taken in the direction of arrow 167 of FIG. 10). As shown in FIG. 12, terminal 174 of tuning component 164 (FIGS. 10 and 11) may be coupled to surface 182 of conductive sidewall using conductive fastener 184. Conductive fastener 184 may include a conductive pin, a conductive screw, welds, solder, conductive adhesive, and/or a conductive spring, as examples. Conductive fastener 184 may mechanically hold the end of substrate 178 in place on surface 182 of conductive sidewall 12W and may serve to short conductive traces 180 on substrate 178 (FIG. 11) to conductive sidewall 12W. Surface 182 may be a ledge structure (e.g., display cover layer 98 may be mounted to surface 182), a conductive bracket, a conductive frame, or any other desired portion of conductive sidewall 12W.

In another suitable arrangement, terminal 174 of tuning component 164 may be coupled to surface 192 using conductive fastener 186. Surface 192 may be a ledge on conductive sidewall 12W, an integral portion of conductive sidewall 12W that forms a part of the rear wall of device 10, a conductive frame, a conductive bracket, conductive traces on a printed circuit board or other substrate, or any other desired conductive structures that are coupled to ground. Conductive fastener 186 may include a conductive pin, a conductive screw, welds, solder, conductive adhesive, and/or a conductive spring, as examples. Conductive fastener 186 may mechanically hold the end of substrate 178 in place on surface 192 and may serve to short conductive traces 180 on substrate 178 (FIG. 11) to conductive sidewall 12W. If desired, conductive fastener 186 may also hold other components such as components 188 in place on surface 192. Components 188 may include a vibrator assembly, speaker assembly, button assembly, sensor assembly, or any other desired components in device 10. In this scenario, terminal 174 of tuning component 164 is mounted within cavity 190 between conductive button assembly structures 168 and conductive sidewall 12W. This example is merely illustrative and, in general, tuning component 164 may be coupled to any desired portion of housing 12. The opposing end of tuning component 164 (e.g., terminal 176 of FIG. 10) may be coupled to conductive display structures 84.

Figure 13:
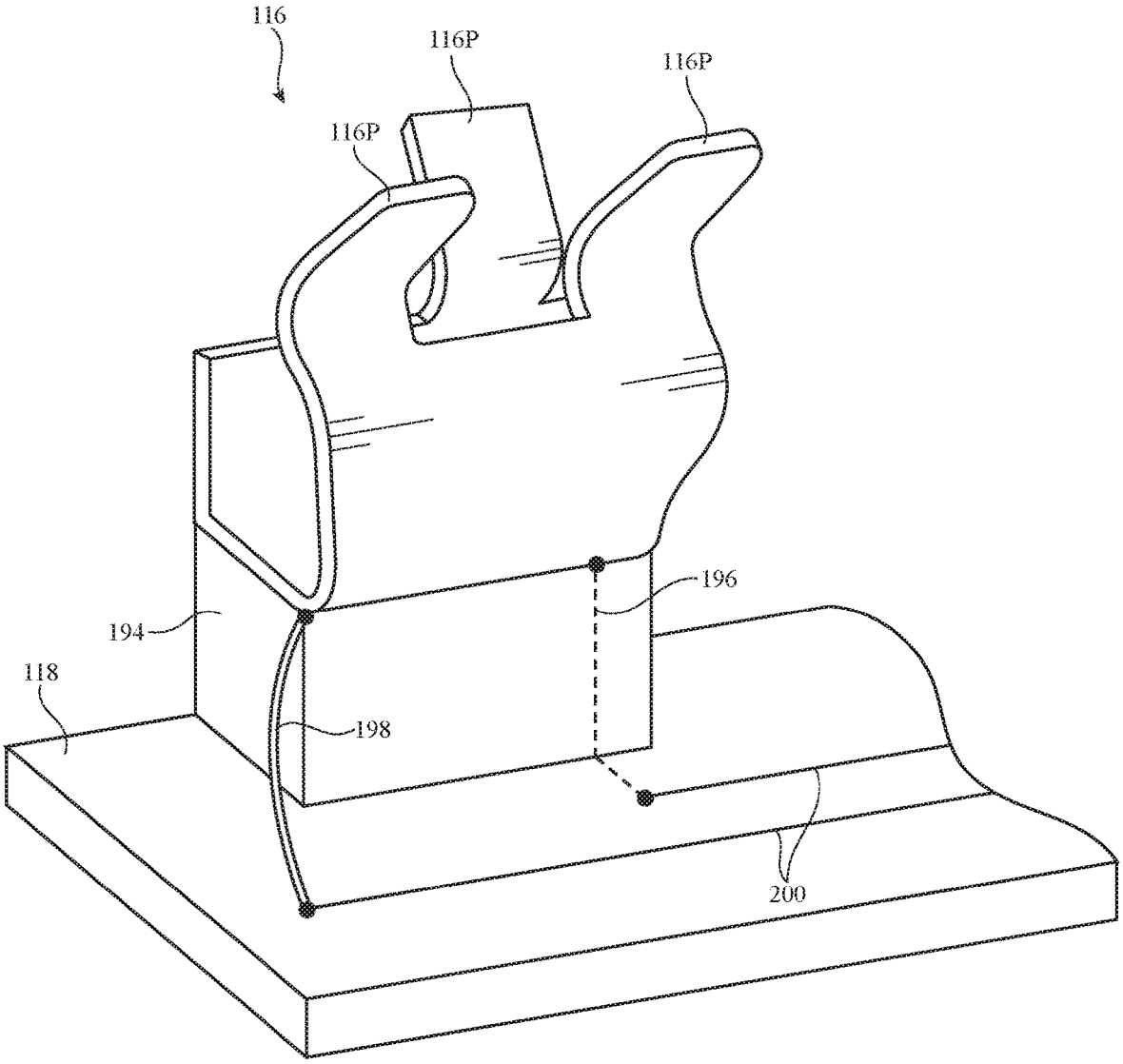
FIG. 13 is a perspective view of an illustrative set of spring fingers that may be used to couple a positive antenna feed terminal to conductive display structures in accordance with an embodiment.

Tabs, clips, or other protruding portions of display module 104 such as tab 112 may serve as positive antenna feed terminal 70 for antenna 40 (FIG. 6). Tab 112 may be received between flexible spring fingers such as metal prongs in clip 116. A perspective view of clip 116 in an illustrative configuration is shown in FIG. 13. As shown in FIG. 13, clip 116 may be mounted on a plastic support structure 194 or other suitable support structures. Plastic support structure 194 may be mounted to dielectric support structure 118. Metal traces such as metal traces 200 on dielectric support structure 118 may route positive antenna feed signals to clip 116. Clip 116 may include prongs 116P that mechanically hold tab 112 (FIG. 6) in place and that electrically couple metal traces 200 on dielectric support structure 118 to positive antenna feed terminal 70. If desired, impedance matching circuitry and other circuitry may be mounted on dielectric support structure 118.

In some scenarios, conductive structures such as conductive structures 196 are formed on or through plastic support structure 194 to couple traces 200 to clip 116. In practice, conductive structures 196 may introduce too great of an inductance to support satisfactory communications across each of the frequency bands of interest. If desired, clip 116 may be coupled to conductive traces 200 via metal wire 198. Metal wire 198 may exhibit less inductance than conductive structures 196. This may, for example, allow for improved antenna efficiency across each of the frequency bands of interest relative to scenarios where conductive structures 196 are used. Metal wire 198 may be coupled to conductive traces 200 using solder or any other desired conductive fastening structures. The example of FIG. 9 is merely illustrative and, if desired, other conductive fastening mechanisms may be used to secure transmission line 60 to positive antenna feed terminal 70 (FIG. 3).

Figure 14:
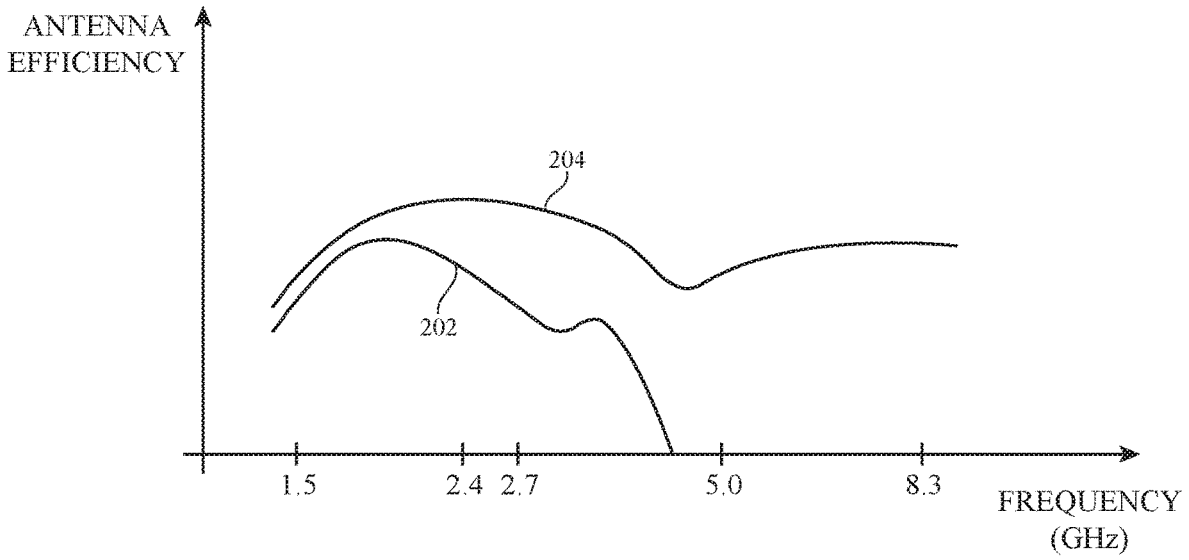
FIG. 14 is a graph of antenna performance (antenna efficiency) for illustrative antenna structures of the types shown in FIGS. 5-13 in accordance with an embodiment.

FIG. 14 is a graph in which antenna performance (antenna efficiency) has been plotted as a function of operating frequency for antenna 40. As shown in FIG. 14, curve 202 plots the antenna efficiency of antenna 40 in the absence of tunable component 164 (FIG. 10) and in the absence of separate low and high band impedance matching circuits (FIG. 8). As shown by curve 202, the length of slot 74 supports an efficiency peak at relatively low frequencies such as frequencies in the GPS band at 1.5 GHz, the cellular midband from 1.4 GHz to 2.2 GHz, and the cellular high band at 2.2 GHz. However, in this scenario, antenna 40 may exhibit relatively low (e.g., insufficient) antenna efficiency in the 2.4 GHz WLAN/WPAN band, the 5.0 GHz WLAN band, cellular bands at frequencies greater than 2.4 GHz, and the UWB band from 5.0 GHz to 8.3 GHz.

Curve 204 plots the antenna efficiency of antenna 40 in scenarios where tuning component 164 (FIG. 10) and matching circuitry 160 (FIG. 9) are present, as well as in scenarios where low band impedance matching circuitry 142 and high band impedance matching circuitry 140 (FIG. 8) are coupled to antenna 40 of FIG. 7 (e.g., in the absence of tuning component 164). As shown by curve 204, length 165 of slot 74 (FIG. 10) supports an efficiency peak at relatively low frequencies such as frequencies in the GPS band at 1.5 GHz, the cellular midband from 1.4 GHz to 2.2 GHz, and the cellular high band at 2.2 GHz. At the same time, length 163 of slot 74 (FIG. 10) supports an efficiency peak at higher frequencies such as frequencies in the 2.4 GHz WLAN/WPAN band and cellular bands above 2.4 GHz. Harmonic modes of length 163 support efficiency peaks at higher frequencies such as frequencies in the 5.0 GHz WLAN frequency band and the UWB band from 5.0 GHz to 8.3 GHz. In this way, antenna 40 may exhibit satisfactory antenna efficiency across each of these bands despite the constrained form factor of device 10. The example of FIG. 14 is merely illustrative. In general, efficiency curve 204 may have other shapes. Curve 204 (i.e., antenna 40) may exhibit efficiency peaks in any desired number of frequency bands and across any desired frequencies.

The foregoing is merely illustrative and various modifications can be made to the described embodiments. The foregoing embodiments may be implemented individually or in any combination.

What is claimed is:

1. An electronic device, comprising:

a housing having conductive housing walls;

a display cover layer mounted to the housing;

a display module that is overlapped by the display cover layer and that includes conductive display structures;

an antenna feed for a slot antenna having a first feed terminal coupled to the conductive display structures and a second feed terminal coupled to the conductive housing walls;

a conductive interconnect structure coupled to the conductive housing walls, wherein the conductive housing walls, the conductive display structures, and the conductive interconnect structure define a perimeter of a slot element for the slot antenna; and an antenna tuning element coupled between the conductive display structures and the conductive housing walls across the slot element.

2. The electronic device defined in claim 1, wherein the slot antenna is configured to radiate in a first frequency band and a second frequency band that is higher than the first frequency band, the antenna tuning element being configured to form a short circuit path between the conductive housing walls and the conductive display structures at frequencies in the first frequency band.

3. The electronic device defined in claim 2, wherein the second frequency band comprises an ultra-wide band (UWB) frequency band, the electronic device further comprising:

radio-frequency transceiver circuitry configured to convey radio-frequency signals in the UWB frequency band using the slot antenna.

4. The electronic device defined in claim 3, wherein the slot antenna is further configured to radiate in a third frequency band between the first and second frequency bands, and the slot element has a harmonic mode configured to radiate in the second frequency band.

5. The electronic device defined in claim 4, wherein the third frequency band comprises a 2.4 GHz wireless local area network (WLAN) frequency band, the UWB frequency band comprises a frequency between 5 GHz and 8.3 GHz, the first frequency band comprises a satellite navigation frequency band and a cellular telephone frequency band, the second frequency band further comprises a 5 GHz WLAN frequency band, and the radio-frequency transceiver circuitry is further configured to convey the radio-frequency signals in the 2.4 GHz WLAN frequency band, the satellite navigation frequency band, the cellular telephone frequency band, and the 5 GHz WLAN frequency band using the slot antenna.

6. The electronic device defined in claim 5, wherein the electronic device comprises a wearable electronic device and the conductive housing walls comprise attachment structures configured to receive a wrist strap.

7. The electronic device defined in claim 4, wherein the antenna tuning element comprises an inductor that is configured to tune a frequency response of the slot antenna in the third frequency band and the UWB frequency band.

8. The electronic device defined in claim 1, wherein the conductive interconnect structure is configured to convey antenna currents for the slot antenna between the conductive display structures and the conductive housing walls.

9. The electronic device defined in claim 8, wherein the slot element extends from a first side of the conductive interconnect structure around the conductive display structures to a second side of the conductive interconnect structure, the antenna tuning element has a first terminal coupled to the conductive display structures and a second terminal coupled to the conductive housing walls, and the first terminal is coupled to a location along the slot element that is interposed between the first feed terminal and the first side of the conductive interconnect structure.

10. The electronic device defined in claim 9, further comprising:

a button mounted to the conductive housing walls at a location along the slot element that is interposed between the second terminal of the antenna tuning element and the first side of the conductive interconnect structure.

11. The electronic device defined in claim 9, wherein the conductive housing walls comprise a ledge, the electronic device further comprising a conductive fastener that couples the second terminal of the antenna tuning element to the ledge.

12. The electronic device defined in claim 8, wherein the conductive interconnect structure comprises conductive adhesive.

13. The electronic device defined in claim 1, further comprising:

a radio-frequency transmission line that includes conductive traces on a substrate;

a metal clip that couples the radio-frequency transmission line to the first feed terminal; and a metal wire that couples the metal clip to the conductive traces on the substrate.

14. The electronic device defined in claim 1, wherein the conductive display structures comprise a conductive structure selected from the group consisting of: a near field communications antenna trace, a touch sensor electrode, pixel circuitry, a conductive frame for the display module, a conductive back plate for the display module, and a conductive shielding structure.

15. A wristwatch comprising:

a housing having conductive sidewalls;

a display cover layer mounted to the conductive sidewalls;

a display module that is overlapped by the display cover layer and that includes conductive display structures;

a slot antenna having a slot element with opposing edges defined by the conductive sidewalls and the conductive display structures, wherein the slot element laterally extends around at least two sides of the conductive display structures;

an antenna feed coupled across the slot element;

radio-frequency transceiver circuitry coupled to the antenna feed and configured to convey radio-frequency signals in a first frequency band and a second frequency band that is higher than the first frequency band using the slot antenna;

a first impedance matching circuit that is coupled between the radio-frequency transceiver circuitry and the antenna feed and that is configured to perform impedance matching for the slot antenna in the first frequency band; and a second impedance matching circuit that is coupled between the radio-frequency transceiver circuitry and the antenna feed and that is configured to perform impedance matching for the slot antenna in the second frequency band.

16. The wristwatch defined in claim 15, further comprising:

a diplexer, wherein the first impedance matching circuitry and the second impedance matching circuitry are coupled to the antenna feed through the diplexer.

17. The wristwatch defined in claim 16, wherein the first frequency band comprises a satellite navigation frequency band, a cellular telephone frequency band, and a 2.4 GHz wireless local area network frequency band, and the second frequency band comprises a 5.0 GHz wireless local area network frequency band and an ultra-wide band (UWB) frequency band.

18. A wristwatch comprising:

a housing having conductive walls;

a display cover layer mounted to the conductive walls;

a display module that is overlapped by the display cover layer and that includes conductive display structures;

a conductive interconnect structure coupled between the conductive display structures and the conductive walls; and an antenna having a slot element, an antenna feed coupled across the slot element, and a tuning element coupled across the slot element, wherein the slot element laterally extends from the conductive interconnect structure around the conductive display structures, a first length of the slot element extending from the conductive interconnect structure to the tuning element is configured to radiate in a first frequency band, and a second length of the slot element extending from the conductive interconnect structure to the antenna feed is configured to radiate in a second frequency band that is higher than the first frequency band.

19. The wristwatch defined in claim 18, wherein a harmonic mode of the second length of the slot element is configured to radiate in a third frequency band that is higher than the second frequency band.

20. The wristwatch defined in claim 19, wherein the first frequency band comprises frequencies between 1.5 GHz and 2.4 GHz, the second frequency band comprises frequencies between 2.4 GHz and 2.7 GHz, and the third frequency band comprises frequencies between 4.9 GHz and 8.3 GHz.

* * * * *